US008070855B2

(12) United States Patent
Strickland

(10) Patent No.: US 8,070,855 B2
(45) Date of Patent: Dec. 6, 2011

(54) METHODS AND APPARATUSES FOR REDUCING EMISSIONS OF VOLATILE ORGANIC COMPOUNDS FROM PUMPS AND STORAGE TANKS FOR VOC-CONTAINING FLUIDS

(76) Inventor: Michael L. Strickland, Odessa, TX (US)

( * ) Notice: Subject to any disclaimer, the term of this patent is extended or adjusted under 35 U.S.C. 154(b) by 261 days.

(21) Appl. No.: 12/806,187

(22) Filed: Dec. 19, 2008

(65) Prior Publication Data

US 2010/0291659 A1 Nov. 18, 2010

Related U.S. Application Data

(63) Continuation-in-part of application No. 11/691,981, filed on Mar. 27, 2007, now Pat. No. 7,951,226, which is a continuation of application No. 11/530,720, filed on Sep. 11, 2006, now abandoned, which is a continuation of application No. PCT/US2005/008329, filed on Mar. 11, 2005.

(51) Int. Cl.
*B01D 53/02* (2006.01)

(52) U.S. Cl. ..... 95/141; 417/437; 435/262; 588/405; 588/409

(58) Field of Classification Search ..... 95/141; 417/437; 435/262; 588/405, 409
See application file for complete search history.

(56) References Cited

U.S. PATENT DOCUMENTS

| | | | | |
|---|---|---|---|---|
| 3,193,595 | A * | 7/1965 | Pierson et al. | 585/402 |
| 3,736,725 | A | 6/1973 | Alleman | |
| 4,279,628 | A | 7/1981 | Wymer | |
| 5,057,227 | A * | 10/1991 | Cohen | 210/680 |
| 5,141,533 | A | 8/1992 | Sowinski | |
| 5,536,303 | A * | 7/1996 | Ebeling | 95/166 |
| 5,543,317 | A * | 8/1996 | Shields et al. | 435/252.3 |
| 5,585,272 | A * | 12/1996 | Pierce et al. | 435/262.5 |
| 5,753,122 | A * | 5/1998 | Taylor et al. | 210/611 |
| 5,928,409 | A * | 7/1999 | Sirkar | 95/45 |
| 6,207,044 | B1 * | 3/2001 | Brimhall | 208/390 |
| 6,461,510 | B1 * | 10/2002 | Boles et al. | 210/606 |

FOREIGN PATENT DOCUMENTS

| | | |
|---|---|---|
| WO | WO 97/19196 | 5/1997 |

* cited by examiner

*Primary Examiner* — Robert J Hill, Jr.
*Assistant Examiner* — Christopher P Jones
(74) *Attorney, Agent, or Firm* — Todd E. Albanesi; Peter V. Schroeder; John Booth

(57) ABSTRACT

A method is provided for reducing emissions of a volatile organic compound ("VOC") from a source of the VOC. The method includes the steps of: (A) operatively positioning a VOC-absorbing material between the source of the VOC and the atmosphere, wherein the VOC from the source of the VOC must pass through the VOC-absorbing material before being vented to the atmosphere, and wherein the VOC-absorbing material comprises: (i) a permeable substrate; and (ii) a stripper for the VOC; and (B) exposing the stripper of the VOC-absorbing material to bacteria, wherein the bacteria is selected for being capable of converting the VOC to another compound. A method for pumping a fluid from a low-pressure fluid source to a high-pressure fluid outlet and a method for storing or transporting a fluid are also provided, wherein the fluid comprises a VOC.

23 Claims, 10 Drawing Sheets

PRIOR ART

PRIOR ART

METHODS AND APPARATUSES FOR REDUCING EMISSIONS OF VOLATILE ORGANIC COMPOUNDS FROM PUMPS AND STORAGE TANKS FOR VOC-CONTAINING FLUIDS

CROSS-REFERENCE TO RELATED APPLICATIONS

This application is a continuation-in-part of U.S. application for patent Ser. No. 11/691,981 filed in the United States Patent and Trademark Office on Mar. 27, 2007, now U.S. Pat. No. 7,951,226, which is a continuation in part of U.S. application for patent Ser. No. 11/530,720 filed in the United States Patent and Trademark Office on Sep. 11, 2006, now abandoned, which is a continuation of PCT/US05/08329, filed Mar. 11, 2005, each of which is incorporated by reference in its entirety.

STATEMENT REGARDING FEDERALLY SPONSORED RESEARCH OR DEVELOPMENT

Not applicable

REFERENCE TO MICROFICHE APPENDIX

Not applicable

TECHNICAL FIELD

The present inventions generally relate to apparatuses and methods for reducing emissions of volatile organic compounds ("VOCs") from VOC sources. An example of a VOC source is a pump for use in pumping a fluid containing VOCs. The VOCs tend to escape from the pump, the VOC emissions usually increasing with increasing use and wear of the pump. One of the most common types of pumps for fluids containing VOCs is positive-displacement pumps. Other examples of VOC sources include storage tanks for fluids containing VOCs, such as tanks, transportation trucks, and transportation barges. The VOCs tend to outgas from the stored fluid over time and when subjected to warmer pumping, storage, or transportation temperatures.

BACKGROUND

The following is a brief description of the general types and classifications of positive-displacement pumps, the major components and operation of a positive-displacement pump (especially a plunger-type pump with reference to the examples shown in FIG. 1 and in FIG. 2 of the drawing), and prior art regarding the problems associated with maintaining the packing for the plungers.

A positive-displacement pump, sometimes referred to as a reciprocating fluid pump or as a reciprocating power pump, is a type of fluid pump driven by power from an outside source applied to the pump. There are several types of reciprocating power pumps. Typically, the pumps are classified as being plunger pumps or piston pumps. A plunger pump is differentiated from a piston pump in that a plunger moves past stationary packing, whereas a piston carries packing with it. A major problem associated with positive-displacement fluid pumps, especially high-pressure pumps, is that of providing a satisfactory seal for the piston or plunger. Another major problem is that the packing may initially provide adequate control of VOC emissions, but, as the packing wears, the VOC emissions increase. Controlling VOC emissions requires frequent changing of the packing, which is expensive maintenance.

The pumps are also classified as either single acting or double acting. In a single-acting pump, liquid is discharged only during the forward stroke of the plunger or piston, that is, during one-half of the revolution. In a double-acting pump, liquid is discharged during both the forward and return strokes of the piston or pair of opposed plungers. That is, discharge takes place during the entire revolution.

Further, the pumps are often classified as being horizontal or vertical. In a horizontal pump, the axial centerline of the cylinder for the piston or plunger is horizontal. In a vertical pump, the axial centerline of the cylinder is vertical.

In addition, the pumps can be classified based on the number of plungers or pistons. A simplex pump contains only one piston or one plunger or a pair of opposed plungers driven by one connecting rod. A duplex pump contains two pistons or two plungers or two pairs of opposed plungers driven by two connecting rods. A multiplex pump contains more than two pistons or two single-acting or opposed plungers. For example, a pump having three plungers or pairs of opposed plungers is commonly referred to as a triplex pump, and a pump having five plungers or pairs of opposed plungers is commonly referred to as a quintuplex pump.

Generally, a positive-displacement pump has a fluid end (sometimes referred to as the liquid end) and a power end.

The fluid end is that portion of the pump that handles the fluid. It consists of a pumping chamber (sometimes referred to as a compression, fluid, or liquid chamber or cylinder), and various ports, valves, and other components.

The pumping chamber is a chamber or plurality of chambers in which the motion of the plunger(s) or piston(s) is imparted to the liquid (or fluid). A piston or plunger is positioned to reciprocate in a cylindrical port, which can be considered to be the pumping chamber or a portion of the pumping chamber. The cylindrical port for the piston or plunger is a heavy-walled structure adapted for withstanding the high forces of containing the reciprocating piston or plunger.

A piston is a cylindrical body that is attachable to a rod and is capable of exerting pressure upon a liquid within the pumping chamber. A piston usually has grooves for containing rings that seal against the generally smooth interior cylindrical wall of the cylindrical port or against a replaceable cylinder liner placed in the cylindrical port as the piston reciprocates.

A plunger is a smooth rod that is attachable to a crosshead and is capable of exerting pressure upon a liquid within the pumping chamber. Sealing rings for a plunger are stationary, the plunger sliding within the rings. The cylindrical port for a plunger-type pump typically has two portions with different diameters, a plunger bore and an axially aligned packing bore. The packing bore has a larger diameter adapted than the plunger bore, so that the packing bore is adapted for accommodating packing between the interior cylindrical wall of the packing bore and the outward cylindrical surface of the plunger.

The pumping chamber can be made integral with a suction manifold and discharge manifold or can be made with separate manifolds. A suction manifold is a chamber that accepts liquid from the suction port(s) and distributes it to the suction valves. A discharge manifold is a chamber that accepts liquid from the individual discharge valves and directs it to the discharge port(s).

The power end is that portion of the pump in which the rotating motion of the crankshaft is converted to a reciprocating motion through connecting rods and crossheads. The power frame is that portion of the power end that contains the crankshaft, connecting rods, crosshead, and bearings used to transmit power and motion to the fluid end.

The power frame of the power end is held in a substantially-permanent, stationary position. The fluid end is typically bolted to the power frame and is cradled by the power frame. Sometimes, a frame extension connects the fluid end to the power frame when the fluid end is not bolted directly to the power frame. In any case, the fluid end is not unbolted and disconnected from the power end except for major maintenance overhaul of the fluid end.

The typical fluid end of a plunger-type pump includes a fluid-end pump body having at least one pumping chamber. The pumping chamber has a suction port (sometimes referred to as an intake port), a discharge port, and a cylindrical port (or, in the case of a double-acting plunger-type pump, a pair of opposed cylindrical ports). The cylindrical port in a plunger-type pump includes a plunger bore and an axially-aligned packing bore. In some pumps, an internal lubrication port is provided for supplying lubricant to the packing bore, which lubricant can be distributed around an internal circumference of the packing bore by a lantern ring, as well know to those skilled in the art. An example of the fluid end of this type of pump with original packing and parts for the packing bore is illustrated in FIG. 1.

A suction valve is positioned in the suction port in a cylindrical portion of the suction port that is sometimes referred to as the suction valve deck), and a discharge valve is positioned in the discharge port (e.g., in a cylindrical portion of the discharge port that is sometimes referred to as the discharge valve deck). In addition, a plunger is positioned to reciprocate in the cylindrical port having the packing bore and the plunger bore.

The suction valve is usually a spring-loaded check valve for allowing the flow of fluid from the low-pressure side of the pump through the suction port into the pumping chamber while preventing the backflow of fluid through the suction port. The discharge valve is usually a spring-loaded check valve for allowing the flow of fluid from the liquid cylinder through the discharge port to the high-pressure side of the pump with preventing backflow of fluid through the discharge port. Preferably, although not necessarily, the suction and discharge valves are vertically disposed in the pump, that is, the axis of each of the generally cylindrical valves is vertically oriented in the pump body. Furthermore, the vertical axes of the suction and discharge valves are preferably, although not necessarily, co-axially aligned.

The plunger of the pump is positioned to reciprocate back and forth in the cylindrical port of the pumping chamber. The cylindrical port consists of a heavy-walled structural body defining the plunger bore and the packing bore, of which at least the interior cylindrical volume of the plunger bore can be considered to be at least a portion of the pumping chamber. The heavy-walled cylinder of the cylindrical port is designed to withstand the high-reciprocating and high-pressure forces to accommodate the plunger. Typically, at the limit of its stroke, the plunger fills nearly the full length of the cylindrical port, and in some designs exceeds the full length of the cylindrical port and extends into another portion of the plumping chamber.

During the back stroke of the plunger, the withdrawal of the plunger increases the volume of the pumping chamber, which creates decreasing fluid pressure or suction in the chamber. This causes the suction valve in the suction port to open to draw fluid from the low-pressure side of the pump into the pumping chamber. The decreased fluid pressure in the chamber also causes the discharge valve in the discharge port to close, preventing fluid from the high-pressure side of the discharge port from backing up into the pumping chamber.

During the forward stroke of the plunger, the insertion of the plunger decreases the volume of the pumping chamber, which creates increasing fluid pressure in the chamber. This causes the discharge valve in the discharge port to open to pump fluid through the discharge valve to the high-pressure side of the pump. The increased fluid pressure in the chamber also causes the suction valve to close, preventing high-pressure fluid from the pumping chamber from being discharged through the suction port.

As mentioned above, a "packing bore" is provided adjacent the plunger bore in the cylindrical port. The packing bore has a generally cylindrical interior wall with an internal diameter ("I.D.") that is larger than an internal diameter of the plunger bore and that is co-axially aligned with the plunger bore. An annular space is defined between the interior wall of the packing bore and a plunger extending through the packing bore into the plunger bore. In other words, the annular space is also substantially the same as the difference between the I.D. of the packing bore and the I.D, of the plunger bore.

The packing bore typically has a "seat" (sometimes referred to as a "land") adjacent the high-pressure end thereof, which is toward the plunger bore. The seat is generally annular in shape, presenting an annular surface generally facing the low-pressure end of the packing bore, which is away from the plunger bore. The annular surface of the seat is preferably at a substantially perpendicular angle relative to the axis of the interior wall of the packing bore, but it can be at an oblique angle. The central opening in the seat allows for insertion of the plunger through the seat. The seat of the packing bore can be formed as a shoulder between the interior wall of the packing bore and the plunger bore.

A removable "gland" (sometimes referred to as a "top gland" or "top piece") is typically positioned adjacent the low-pressure end of the packing bore, which is away from the plunger bore. The gland is for axially capturing and squeezing the packing material or packing set positioned in the annular space within the interior wall of the packing bore against the seat of the packing bore. A central opening in the gland allows for insertion of the piston rod or plunger through the gland.

The gland is generally annular in shape, presenting an annular surface generally facing the high-pressure end of the packing bore, which is toward the plunger bore. The annular surface of the gland is preferably at a substantially perpendicular angle relative to the axis of the interior wall of the packing bore, but it can be at an oblique angle.

The removable gland typically is formed as a part of a body adapted to be removably secured to the body forming the interior wall of the packing bore. For example, the gland can have a circumferential flange or flange lobes through which bolts can be secured to the body forming the interior wall of the packing bore. In another design, the gland can have a circumferential threaded connector adapted to screw with a corresponding circumferential threaded connector on the body forming the interior wall of the packing bore, in which case the gland is sometimes referred to as a "gland nut."

The packing bore is for accommodating relatively soft "packing" in the annular space between the interior wall of the packing bore and the plunger. The packing is for sealingly engaging the plunger to help prevent fluid leakage from around the plunger as it reciprocates in the plunger bore, which enables the compression of fluids in the pumping chamber.

The packing bore can accommodate various styles of packing. Historically, loose packing material was simply "stuffed" into the packing bore. Early on, packing material was formed into ring-shaped packing elements. The packing elements can be formed into rings having a rectangular or square cross section. The packing rings can be split rings to facilitate assembly or removal of the packing rings from the packing bore. Because the packing material is relatively soft, a plurality of such packing elements is often backed up with intermediate rigid washer-shaped rings or spacers. More recently, the engineering of the packing rings and other associated parts of the packing set has become increasingly sophisticated. The stack of the plurality of packing elements, intermediate spacers, and other pieces that can be used in the packing bore are collectively referred to as a "packing stack" or "packing set" or "packing assembly."

The seat of the packing bore provides a land area for the packing set, including the packing and associated parts and pieces. With the packing rings and other pieces of a packing set positioned in place in the packing bore against the seat, the plunger is inserted through the packing set. Then the gland is then positioned in place over the packing set. The gland, when tightened, axially compresses and squeezes the packing set. This action causes the shape of soft packing material to distort, creating a tight sealing area between the packing bore and the outside diameter of the plunger, preventing any substantial leak of internal compressed fluids from around the plunger.

The packing material (or packing set) is axially captured and retained within the interior wall of the packing bore between the seat of the packing bore and the gland, which is positioned and tightened over the packing. Over-tightening of the gland on the packing can cause excessive friction as the plunger reciprocates through the packing elements, causing excess wear, heat, and even breakage of the plunger.

As mentioned above, a major problem associated with positive-displacement fluid pumps, especially high-pressure pumps, is that of providing a satisfactory seal for the plunger. This seal has normally been in the form of soft, nonabrasive packing elements adapted to seal the annular space between the pump plunger and the bore of the packing bore. During the power stroke of the plunger, the internal pump pressure acting axially on the packing set helps the packing rings to deform or deflect into sealing engagement between the reciprocating plunger and the packing bore.

Of course, the packing seals wear as the plunger reciprocates, and the fluid pumps require periodic maintenance to replace the worn seals. The wear on the plunger packing is a particularly serious problem when the fluid being pumped contains suspended particles of silt, clay, sand, or other abrasive material. The abrasive material tends to erode the packing causing early and frequent failure. Packing failure is normally evidenced by the leakage of fluid past the packing. A small amount of leakage can be tolerated, but, when this becomes excessive, the pumping operation must be stopped to permit replacement of the packing.

The typical packing needs to be replaced ever few months of pump operation. This maintenance involves tedious and time-consuming operations, including removal of the packing gland, removal of the worn packing elements from the packing bore, re-assembly of new packing elements in the packing bore, and replacement and proper tightening of the gland.

Eventually, typically after about two-to-three years of pump operation, however, the packing bore itself will require a major overhaul. During the reciprocating action of the plunger, the parts and pieces of the packing set have slight movement and this, along with corrosion, vibration and other factors, will cause the packing bore surface to deteriorate. Further, as the packing wears and loosens, the packing increasingly will, in turn, wear on the interior cylindrical wall of the plunger bore. Eventually, the packing bore becomes useless as a sealing surface to prevent the compressed product from escaping from the pumping chamber to the pump exterior. Then it becomes necessary to recondition the packing bore diameters in a major overhaul of the pump. This is usually done by boring out the packing bore inside diameter to accommodate a sleeve, which replaces the original packing bore scaling surfaces with a new one.

Sometimes it is desirable to change the size of the plunger. The diameter of the packing bore, however, must be in a reasonable proportion to the diameter of the plunger and have a sufficient clearance to accommodate the cross\section of the packing. For example, a plunger having a 2-inch diameter can be positioned in a packing bore having a 3-inch diameter, which provides a typical circumferential clearance of 0.5 inch. This allows for a packing material having a 0.5 inch cross section (if square packing material is used) to fill the annular space between the outside diameter of the plunger and the internal packing bore diameter.

When it is desired to change the size of the plunger, the packing bore would then be of the wrong proportion. Many times, for example, it is desirable to increase pump internal pressures. One way of doing this is to decrease the plunger diameter. Doing this, of course, increases the clearance between the plunger bore and plunger outer diameter. Up to a reasonable extent, the increased clearance can be compensated with a packing having a larger cross section. Alternatively, it is possible to re-bore and sleeve the original packing bore to reduce the internal diameter of the packing bore, and allow for the use of a packing having a more-appropriate cross section. However, this alternative requires major overhaul of the pump.

In many pumps, the packing bore is formed integrally as part of the fluid-end body. An example of this type of prior-art pump is illustrated in FIG. 1, which is hereinafter described in detail.

In a few pumps, a "stuffing box" is captured permanently in the fluid-end body by the attached power frame, in which case this stuffing box provides the packing bore. An example of this design is the Wheatley® "323" pump as illustrated in FIG. 2, which is hereinafter described in more detail. However, this stuffing-box design is adapted for major overhaul of the fluid end and does not allow for the removal of the stuffing box without removing the fluid end from the power frame. Essentially, the packing bore is formed in a non-integrally formed, but permanently installed stuffing box in a fluid-end body. The packing is routinely maintained without removal of this type of permanently-installed stuffing box.

In other pumps, a "stuffing box" is bolted permanently to the fluid-end body of the pump, although it can be removed without removal of the fluid end from the power frame. Such a separate stuffing box is massive and expensive because, in essence, it is a structural portion of the fluid end body. Essentially, the packing bore is formed in a non-integrally fowled, but permanently attached stuffing box to a fluid-end body. The packing is routinely maintained without removal of this type of permanently-attached stuffing box. When the packing bore wears to the point it needs major service, such a stuffing box portion of the fluid-end body can be removed for easier re-manufacturing or re-sleeving.

It should be understood that a positive-displacement pump is only one common type of pump, and other types of pumps may be used for pumping VOC-containing fluids. It should also be understood that VOC-containing fluids are stored or transported in various types of fluid tanks. The VOCs tend to outgas from these sources. It would be desirable to have improved apparatuses and methods for reducing emissions of VOCs from such sources.

SUMMARY OF THE INVENTION

According to one aspect of the invention, a method is provided for reducing emissions of a volatile organic compound from a source of the VOC. The method includes the steps of: (A) operatively positioning a VOC-absorbing material between the source of the VOC and the atmosphere, wherein the VOC from the source of the VOC must pass through the VOC-absorbing material before being vented to the atmosphere, and wherein the VOC-absorbing material comprises: (i) a permeable substrate; and (ii) a stripper for the VOC; and (B) exposing the stripper of the VOC-absorbing material to bacteria, wherein the bacteria is selected for being capable of converting the VOC to another compound.

According to another aspect of the inventions, a method for pumping a fluid from a low-pressure fluid source to a high-pressure fluid outlet is provided, wherein the fluid includes a volatile organic compound. The method comprises the steps of: (A) operatively positioning a VOC-absorbing material between an enclosure for a pump and the atmosphere, wherein the VOC from the enclosure must pass through the VOC-absorbing material before being vented to the atmosphere, and wherein the VOC-absorbing material comprises: (i) a permeable substrate; and (ii) a stripper for the VOC; (B) reciprocating the piston or plunger in the cylindrical port to pump fluid from the low-pressure fluid source to the high-pressure fluid outlet; and (C) exposing the stripper of the VOC-absorbing material to bacteria, wherein the bacteria is selected for being capable of converting the VOC to another compound.

According to yet another aspect of the inventions, a method for storing or transporting a fluid is provided, wherein the fluid includes a volatile organic compound. According to this aspect, the method includes the steps of: (A) storing or transporting the fluid in a closed container; (B) operatively positioning a VOC-absorbing material between the container and the atmosphere, wherein the VOC from the container must pass through the VOC-absorbing material before being vented to the atmosphere, and wherein the VOC-absorbing material comprises: (i) a permeable substrate; (ii) a stripper for the VOC; and (iii) exposing the stripper of the VOC-absorbing material to bacteria, wherein the bacteria is selected for being capable of converting the VOC to another compound.

The methods and apparatuses according to the inventions help reduce emissions of a VOC from such sources of the VOC. The methods and apparatuses according to the inventions include for pumping of a fluid that includes a VOC while providing the advantage of reducing emissions of the VOC to the atmosphere. The methods and apparatuses according to the inventions include for storage or transportation of a fluid that includes a VOC while providing the advantage of reducing emissions of the VOC to the atmosphere. Further, the methods and apparatuses according to the inventions provide methods for regeneration or disposal of the stripper for the VOC.

These and other objects, aspects, and advantages of the inventions will become apparent to persons skilled in the art from the following drawings and detailed description of presently most-preferred embodiments of the inventions.

BRIEF DESCRIPTION OF THE DRAWING

The accompanying views of the drawing are incorporated into and form a part of the specification to illustrate several aspects and examples of the present inventions, wherein like reference numbers refer to like parts throughout the figures of the drawing. These figures together with the description serve to explain the general principles of the inventions. The figures are only for the purpose of illustrating preferred and alternative examples of how the various aspects of the inventions can be made and used and are not to be construed as limiting the inventions to only the illustrated and described examples. The various advantages and features of the various aspects of the present inventions will be apparent from a consideration of the drawings.

DETAILED DESCRIPTION OF THE PRESENTLY MOST-PREFERRED EMBODIMENTS AND BEST MODES

Figure 1:
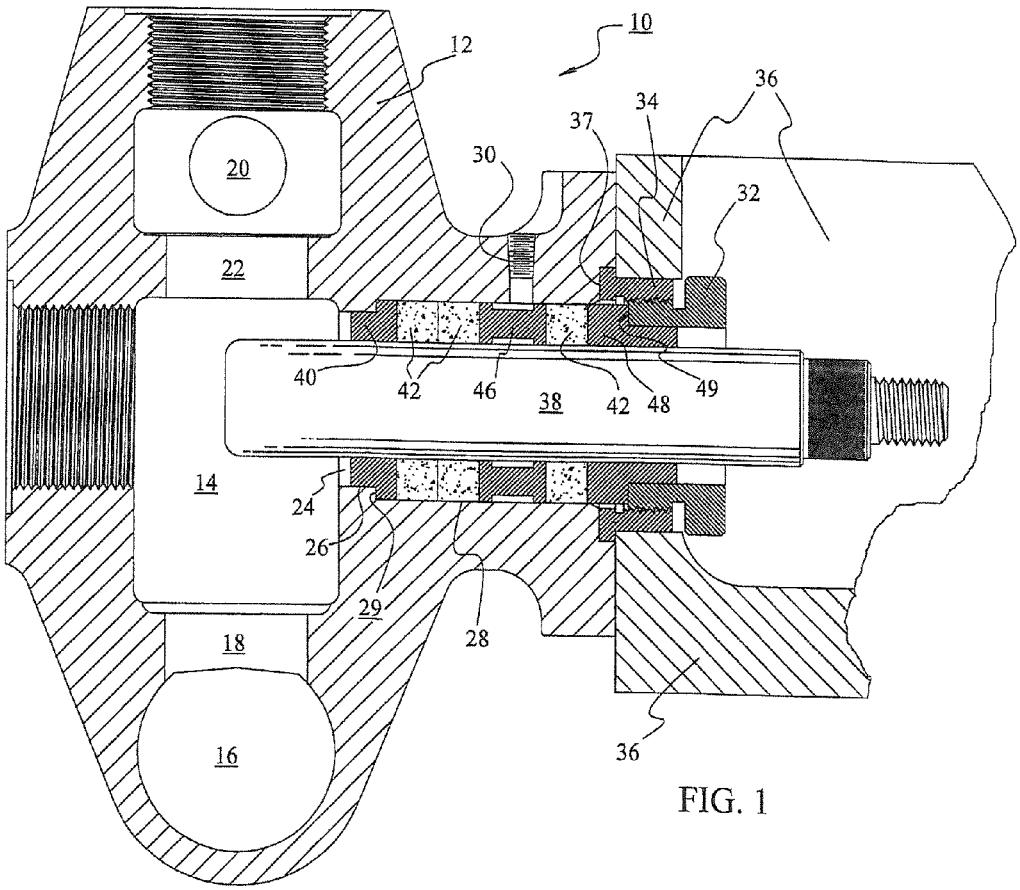
FIG. 1 is a cross-sectional view of a fluid end of a typical prior-art plunger-type pump known as the "323 Wheatley," illustrating that the fluid end defines a pumping chamber having a fluid intake port with a suction valve deck, a fluid discharge port with a discharge valve deck, and a cylindrical port with a packing bore and a plunger bore. A typical prior-art packing arrangement is illustrated in the packing bore, and a gland, such as a gland nut can be used to secure the packing and other parts in the packing bore and against the seat of the packing bore.

As used herein and in the appended claims, the words "comprise" and "include" and all grammatical variations thereof are each intended to have an open, non-limiting meaning that does not exclude additional elements or parts of an assembly, subassembly, or structural element.

As used herein, terms such as "first," "second," "third," etc. are assigned arbitrarily and are merely intended to differentiate between two or more parts that are similar or corresponding in structure and/or function. It is to be understood that the words "first" and "second" serve no other purpose and are not part of the name or description of the following terms. Furthermore, it is to be understood that the mere use of the term "first" does not require that there be any "second" similar or corresponding part, either as part of the same element or as part of another element. Similarly, the mere use of the word "second" does not require that there by any "third" similar or corresponding part, either as part of the same element or as part of another element, etc.

As defined herein, a "packing cartridge" is an apparatus that is adapted to be at least partially positioned in the packing bore of a plunger-type pump. As described below in more detail, the packing bore of the pump can be formed integrally in the fluid end or it can be provided by a stuffing box. As most of the parts of the packing cartridge are generally ring shaped or cylindrical, the term "axial" refers to the geometrical axis of a part having a generally circular or cylindrical shape, such as a ring, packing bore, tubular sleeve, etc. The term "co-axial" means that the parts or elements are arranged to have aligned and co-extending geometrical axes. The term "co-axially spaced" means that the elements are positioned in a co-axial relationship but are spaced apart some distance measured along their common axis. The term "co-axially overlapping" means that the elements are positioned in a co-axial relationship and are overlapping in an axial direction.

Further, it is also to be understood that relative terms such as "top," "bottom," "length," "height," "width," "outward," "inward," "thickness," "depth," etc. also are assigned arbitrarily for convenient reference.

For example, certain terms are assigned arbitrarily with reference to the high-pressure and low-pressure sides of the packing cartridge. Thus, as used herein with reference to the packing or cartridge, "top" or "upper" means away from the high-pressure side of the packing and towards the low-pressure side. Similarly, "bottom" or "lower" means away from the low-pressure side of the packing and toward the high-pressure side of the packing.

Further, as used herein, "length," "height," and variations thereof will indicate a measurement in a direction parallel to the axial direction. As used herein with reference to the packing or cartridge, the terms "outer," "outward," "inner," or "inward" and variations thereof generally will refer to a radial direction perpendicular to the axial direction, where "outer" or "outward" refers to a direction extending radially outward or away from the geometrical axis and where "inner" or "inward" refers to a direction extending radially inward or toward the geometrical axis. In addition, the terms "thickness" and "depth" generally will refer to a radial measurement relative to a geometrical axis, such as the radially-extending thickness of a ring or the radially-extending depth of a groove.

Similarly, as most parts of the packing cartridge are generally ring shaped or cylindrical, structural features are defined in that context. For example, as used herein with reference to the packing or cartridge, the term "wall" generally refers to the body forming a circumferential surface parallel to a geometrical axis. In addition, the term "shoulder" refers to the body forming an annular surface that is perpendicular to the geometrical axis of the element. Accordingly, for example, a circumferential groove has a wall and two shoulders, i.e., an upper, downwardly-facing shoulder and a lower, upwardly-facing shoulder.

For the sake of consistency of usage, once a reference or relational term is assigned arbitrarily to help describe a structure or feature in a particular figure, the term then will be used consistently to refer to like parts throughout the other figures of the drawing. The same reference or relational term is later used even if the orientation of a structure is different in another figure. It is to be understood that, unless the context otherwise requires, the use of such arbitrarily-assigned relational or relative terms is not to be construed as unnecessarily limiting the inventions.

In general, unless otherwise expressly stated, the words or terms used in this disclosure and the claims are intended to have their ordinary meaning to persons of skill in the art. Initially, as a general aid to interpretation, the possible definitions of the words used herein are intended to be interpreted by reference to comprehensive general dictionaries of the English language published before or about the time of the earliest filing of this application for patent. Where several different general definitions are available, it is intended that the broadest definitions or senses be selected that are consistent with the description of the presently most-preferred embodiments of the invention, including without limitation as shown in the drawing.

After initially consulting such general dictionaries of the English language, it is intended that the words or compound terms be further defined or the most appropriate general definition or definitions be selected by consulting engineering dictionaries, encyclopedias, treatises, and relevant prior art to which these inventions pertain. Finally, if necessary to resolve any remaining doubt, utilizing the patent record may be helpful to select from the possible definitions.

Of course, terms made up of more than one word (i.e., compound terms), such as "packing bore," may not be found in general dictionaries of the English language. Compound terms are intended to be interpreted as a whole, and not by parsing the separate words of the compound term, which might result in absurd and unintended interpretations. In general, compound terms are to be interpreted as they would be understood in the art, consistent with the usage in this specification and with reference to the drawing.

It is intended that examining relevant general dictionaries, encyclopedias, treatises, prior art, and the patent record will make it possible to ascertain the appropriate meanings that would be attributed to the words and terms of the description and claims by those skilled in the art, and the intended full breadth of the words and terms will be more accurately determined. In addition, the improper importation of unintended limitations from the written description into the claims will be more easily avoided.

According to one aspect of the inventions, a method is provided for reducing emissions of a volatile organic compound from a source of the VOC. The method includes the steps of: (A) operatively positioning a VOC-absorbing material between the source of the VOC and the atmosphere, wherein the VOC from the source of the VOC must pass through the VOC-absorbing material before being vented to the atmosphere, and wherein the VOC-absorbing material comprises: (i) a permeable substrate; and (ii) a stripper for the VOC; and (B) exposing the stripper of the VOC-absorbing material to bacteria, wherein the bacteria is selected for being capable of converting the VOC to another compound. According to the inventions, the source of the VOC can be selected from equipment for pumping, storing, handling, or transporting a VOC-containing fluid. By way of illustration, the inventions will be described first with reference to the structure of a typical plunger-type pump.

Packing Bore Context of Typical Plunger-type Pump

FIG. 1 is a cross-sectional view of a fluid end 10 of a typical prior-art plunger-type pump known as the "323 Wheatley." The fluid end 10 has a body 12 defining a pumping chamber 14 having a fluid intake or suction port 16 with a suction valve deck 18, a fluid discharge port 20 with a discharge valve deck 22, and a cylindrical port 24 with a plunger bore 26, and a packing bore 28.

The packing bore 28 has a larger diameter than the plunger bore, so that the packing bore is adapted for accommodating packing between the interior cylindrical wall of the packing bore and the outward cylindrical surface of the plunger. The packing bore 28 has a seat 29 adjacent the high-pressure end thereof. The seat 29 is generally annular in shape, presenting an annular surface generally facing the low-pressure end of the packing bore 28, which is away from the plunger bore 26. The annular surface of the seat 29 is preferably at a substantially-perpendicular angle relative to the axis of the interior wall of the packing bore, but it can be at an oblique angle. The central opening in the seat 29 allows for insertion of the plunger through the seat. The seat 29 of the packing bore 28 can be formed as a shoulder between the interior wall of the packing bore 28 and the plunger bore 26.

In this example, the fluid end has a lubrication port 30 integrally formed in the fluid-end body for delivering a lubricating fluid directly into the packing bore 28. This is sometimes referred to as a fluid end having internal lubrication.

A typical prior-art packing arrangement is illustrated in the packing bore 28, and a gland, such as a gland nut 32 can be used to secure the packing and other parts in the packing bore and against the seat of the packing bore.

In this example, the gland nut 32 has a threaded portion that is screwed into a correspondingly-threaded portion of a gland adapter 34. A flange portion 37 of the gland adapter 34 is captured between the fluid-end body 12 and the power frame 36 by the attachment of the fluid end 12 to the end of the power frame 36 (partially shown) of the power end (not shown). The gland adapter body 34 acts as a line up boss for the fluid-end body 12 on the power frame 36. The fluid-end body 12 has a plurality of studs (not shown) that go through the power frame 36 that bolts the two together. The power frame 36 of the power end (not shown) is held in a substantially-permanent, stationary position. The fluid-end body 12 typically is bolted to the power frame 36 and is cradled by the power frame 36. The fluid-end body 12 is not unbolted and disconnected from the power frame 36 except for major maintenance overhaul of the fluid end.

The plunger 38 of the pump is positioned to reciprocate back and forth in the cylindrical port 24 of the pumping chamber 14, including through the plunger bore 26 and the packing bore 28, and also through an opening in gland nut 32. The cylindrical port 24 is formed in the heavy-walled fluid-end body 10. The heavy-walled cylindrical port 24 is designed structurally to withstand the high-reciprocating and high-pressure forces to accommodate the plunger 38.

Typical packing set elements that can be used in a packing bore 28, include, for example, a bottom abutment ring 40, a plurality of packing rings 42, a lantern ring 46, and an upper abutment ring 48. The upper abutment ring 48 has a shoulder portion 49 that can be compressed axially by the gland nut 32. It is important not to over tighten the gland nut 32, however, or the packing will be over tightened against the plunger 38, causing excessive friction wear and even breakage of the plunger 38.

Routine maintenance of the packing bore 28 is a tedious process. Typical maintenance involves, for example, the steps of removing the gland nut 32, removing the plunger 38, removing the various existing packing set elements from the packing bore 28, replacing the packing rings and replacing or cleaning certain other packing elements of the packing set, reassembling the packing set elements in the packing bore 28, re-insertion of the plunger 38, and proper tightening of the gland nut 32. The access to the packing bore 28 is often inconvenient, and the working conditions for these tasks are often outdoors and difficult.

Figure 2:
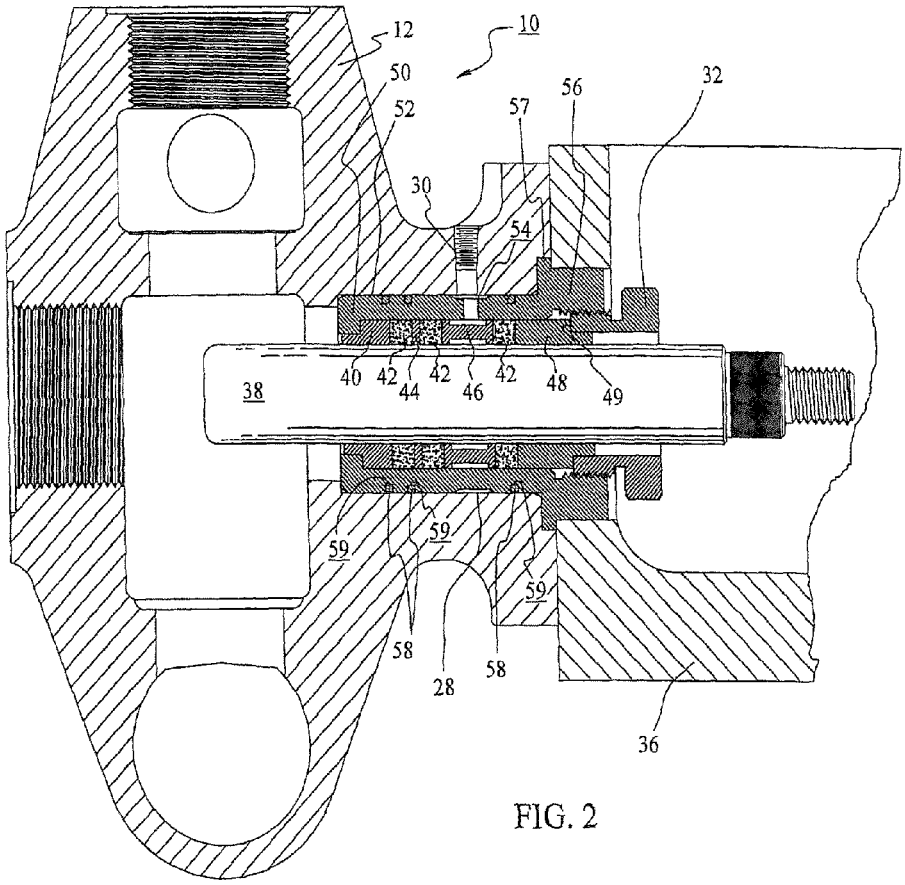
FIG. 2 is a cross-sectional view of a fluid end and power-frame attachment of a typical prior-art plunger-type pump known as the "323 Wheatley," similar to that shown in FIG. 1, illustrating a prior-art stuffing box that is secured permanently in the cylindrical port unless the fluid end is removed from the power frame. In this case, the stuffing box provides the packing bore.

FIG. 2 is a cross-sectional view of a fluid end 10 and power-frame attachment of a typical prior-art plunger-type pump known as the "323 Wheatley," generally similar to that shown in FIG. 1, illustrating a prior-art stuffing box 50 that is secured permanently in a stuffing-box bore 52 formed in the fluid-end body 12. In this case, the stuffing box 50 provides the packing bore 28. The stuffing box 50 cannot be removed unless the fluid-end body 12 is removed from the power frame 36 (partially shown), In this example of FIG. 2, the fluid end 10 has a lubrication port 30 integrally formed in the fluid-end body 12 for delivering a lubricating fluid directly into the packing bore 28. To accommodate the lubrication port 30, the stuffing box 50 can have an integrally formed lantern-ring portion 54.

The stuffing box 50 has an integrally formed glad-adapter portion 56. A flange portion 57 of the gland adapter portion 56 is captured between the fluid-end body 12 and the power frame 36 by the attachment of the fluid-end body 12 to the end of the power frame 36 (partially shown) of the power end (not shown). The gland nut 32 has a threaded connection to the gland-adapter portion 56. In this example, gland-adapter portion 56 of the stuffing box 50 also acts as a line-up boss for the fluid-end body 12 on the power frame 36. Similar to the previous example, the fluid-end body 12 has a plurality of studs (not shown) that go through the power frame 36 that bolts the two together. The power frame 36 of the power end (not shown) is held in a substantially-permanent, stationary position. The fluid end 10 typically is bolted to the power frame 36 and is cradled by the power frame 36. The fluid-end body 10 is not unbolted and disconnected from the power frame 36 except for major maintenance overhaul of the fluid end. Thus, this type of stuffing box 50 is not removed from the fluid end for routine maintenance of the packing bore 28.

A plurality of o-ring seals 58 are positioned in o-ring retaining grooves 59 in the outer wall of the stuffing box 50. The o-ring seals 58 help prevent fluid leakage around the stuffing box 50 from the internal lubrication provided by the internal lubrication port 30 and the lantern-ring portion 54.

Typical packing\-set elements that can be used in the packing bore 28 of stuffing box 50 are the same as for any other packing bore, including, for example, as illustrated in FIG. 2, a bottom abutment ring 40, a plurality of packing rings 42, one or more back-up rings 44, a lantern ring 46, and an upper abutment ring 48. The upper abutment ring 48 has a shoulder portion 49 that can be compressed axially by the gland nut 32. It is important not to over tighten the gland nut 32, however, or the packing will be over tightened against the plunger 38, causing excessive friction wear and even breakage of the plunger 38.

Routine maintenance of the packing bore 28 of this type of stuffing box 50 is the same type of tedious and difficult process as for a packing bore integrally formed in the fluid-end body 12. Typical maintenance, involves, for example, the steps of removing the gland nut 32, removing the plunger 38, removing the various existing packing-set elements from the packing bore 28, replacing the packing rings and replacing or cleaning certain other packing elements, re-assembling the packing set elements in the packing bore 28, re-insertion of the plunger 38, and proper tightening of the gland nut 32. The access to the packing bore 28 is often inconvenient, and the working conditions for these tasks are often outdoors and difficult.

Similarly, even for a stuffing-box design that is adapted to be bolted to the fluid-end body without requiring removal of the fluid-end body from the power frame, many of the same difficulties are presented in the routine maintenance of the packing bore. For example, such a stuffing-box design must be a heavy-walled body with sufficient structure to contain and withstand the forces of the reciprocating plunger in the stuffing box. Essentially, such a stuffing box design is merely a non-integrally formed fluid-end body for providing a packing bore.

Packing Cartridge Embodiments For Use in a Packing Bore

According to certain aspects of the inventions, various packing cartridges are provided for the packing bore. According to certain aspects of the inventions, a self-contained, replaceable packing cartridge can be adapted to replace pre-existing packing stacks for a plunger-type pump.

The packing cartridges according to the inventions are not required to be mounted permanently in the fluid end of the pump by any portion of the power frame. In addition, these packing cartridges can be used as a replaceable packing bore insert, aiding in convenience and reducing the expense relative to maintaining the packing and reconditioning the packing bore formed in a fluid-end body or existing stuffing box. The packing cartridges can be used to replace old packing-set elements with a pre-assembled cartridge instead of taking the time to tediously replace parts and pieces of conventional packing, out in the field and sometimes in hard-to-reach access to the packing bore. In addition, some of the packing cartridges according to the inventions can be used to provide a pre-determined packing crush pressure to the packing.

According to preferred embodiments of these inventions, packing cartridges of the types disclosed in U.S. application patent Ser. No. 11/530,720, filed in the United States Patent and Trademark Office on Sep. 11, 2006 is hereby incorporated by reference in its entirety.

Continuing Problem of VOCs

The continuing problem of volatile organic compound emissions is well known with positive displacement pumps used for pumping hydrocarbon material, such as oil or gas. For example, the current environmental regulatory standards in the State of Texas, USA for VOC emissions are believed to be less than 10,000 parts per million ("ppm") in the surrounding air as measured in the vicinity of the pump. The standards actually may be on the order of 500 ppm or the standards may be tightened. While the packing cartridges described above, including those with the pressure-dampening ring, are initially capable of meeting regulatory standards for VOC emissions, excessive and highly-costly packing maintenance would be required to maintain VOC emissions at or below regulatory standards.

As used herein, "volatile" means that a chemical compound has either a vapor pressure under normal conditions of at least 5 ton or an evaporation rate relative to n-butyl acetate of at least 0.5. Such a volatile chemical compound can vaporize significantly and enter the atmosphere. As used herein, "normal conditions" means 15° C. (77° F.) and 1 atmosphere pressure (101.325 pascals; 760 torr).

At any given temperature, for a particular chemical compound, there is a pressure at which the gas of that compound is in dynamic equilibrium with its liquid or solid forms. The equilibrium vapor pressure is an indication of a liquid's evaporation rate. Evaporation rates generally have an inverse relationship to boiling points; i.e., the higher the boiling point, the lower the rate of evaporation. The general reference material for evaporation rates is n-butyl acetate (commonly abbreviated BuAc). Whenever a relative evaporation rate is given, the reference material must be stated. ASTM International (originally known as the American Society for Testing and Materials) has developed a standard test method, D3539-87 (2004) Standard Test Methods for Evaporation Rates of Volatile Liquids by Shell Thin-Film Evaporometer.

It should be understood that a particular VOC can have a normal physical state that is a liquid or a gas under normal conditions. For example, benzene is a liquid under normal conditions, and it has an evaporation rate into the atmosphere under normal conditions. Methane is a gas under normal conditions, i.e., its normal boiling point is lower than the temperature of normal conditions. The "normal boiling point" (also known as the atmospheric boiling point or the atmospheric pressure boiling point) of a liquid is the special case in which the vapor pressure of the liquid equals the defined atmospheric pressure at sea level, 1 atmosphere.

As used herein, "organic compound" generally means a carbon-based molecule, however, as used herein, this term does not include carbon-based molecules that typically are considered inorganic, such as carbon monoxide or carbon dioxide.

Accordingly, as used herein, "volatile organic compound" (VOC) includes chemicals such as methane ($CH_4$), aldehydes, ketones, and other "light" hydrocarbons. (The term "VOC" is often used in legal or regulatory contexts, where the precise definition is a matter of law, but such definitions are not included herein.)

Examples of VOCs include some aromatic compounds, such as benzene, toluene, ethyl benzene, and xylenes. Emission of such volatile aromatic compounds is regulated, and disposal of materials containing such volatile aromatic compounds is also regulated.

Other examples of VOCs include some fluorocarbons, chlorocarbons, and chlorofluorocarbons. A fluorocarbon (also known as an organofluoride, organofluorine, or fluorinated solvent) is an organic compound containing at least one covalently-bonded fluorine atom. A chlorocarhon (also known as an organochloride, organochlorine, or chlorinated solvent) is an organic compound containing at least one covalently-bonded chlorine atom. Chlorofluorocarbons (CFCs) are fluorocarbons that also contain at least one covalently-bonded chlorine atom.

Especially problematic VOCs include one or more compounds from the group consisting of: green house gases, benzene, toluene, ethyl benzene, xylene, and any combination thereof in any proportion.

VOC-Absorbing Material

According to the inventions, the VOC-absorbing material is provided for use in the methods. The VOC-absorbing material comprises: (i) a permeable substrate; and (ii) a stripper for the VOC.

The stripper is preferably absorbed into a solid substrate. The solid substrate has sufficient permeability to allow a gas to easily pass through the solid substrate. The permeability of the substrate can break a gas stream into multitudinous tiny gas streams as it passes through the substrate. The stripper coats the surfaces of the substrate material. The stripper absorbed into the solid substrate and coated onto its surfaces provides a high surface area for contact with a gaseous stream. Examples of such solid substrates include: sand, coffee grounds, kitty litter, particulate oil absorbent, and sponges. Preferably, the substrate comprises sponge material, and any combination thereof in any proportion. For example, the substrate can include a peat moss. According to a presently most-preferred embodiment of the inventions, the peat moss is Sphagnum peat moss. The peat moss is preferably heat activated or dried to about 10% moisture content, which helps it to also absorb a VOC.

A stripper is employed to absorb at least one example of a VOC, preferably a VOC contained in a fluid that is to be pumped, stored, transported, piped, or otherwise handled. As used herein, "stripper" means capable of absorbing or dissolving at least one example of a VOC and substantially retaining the VOC within the stripper material. Preferably, the VOC striper is capable of absorbing at least 5% by weight of the example of a VOC. More preferably and particularly, the VOC stripper is capable of absorbing at least 5% by weight of benzene. As used herein, "substantially retaining" the VOCs within the material means the absorbed VOC has a substantially-reduced vapor pressure or evaporation rate under normal conditions compared to the same VOC that is not absorbed into the VOC stripper. As used herein, "substantially reduced" means reduced by at least 20%.

Preferably, the stripper does not include any appreciable concentration of a VOC, at least initially before contacting the VOC to be absorbed before venting to the atmosphere. More preferably, prior to containing any VOC to be removed from a gas stream to be vented to the atmosphere, the stripper does not include any organic compound that has a vapor pressure greater than 1 torr or an evaporation rate greater than 0.1 relative to n-butyl acetate.

Preferably, the stripper comprises a chemical compound that is in a liquid physical state under normal conditions. Examples of liquid VOC strippers include, without limitation, non-volatile organic solvents. Examples of suitable non-volatile organic solvents include glycols such as: monoethylene glycol, diethylene glycol, triethylene glycol, and tetraethylene glycol. According to a presently most-preferred embodiment, the stripper comprises diethylene or triethylene glycol. In contrast, although marginally suitable, monoethylene glycol is believed to be less than ideal because it has a reported vapor pressure of 0.08 torr @ 20° C. (68° F.) and an evaporation rate of less than 0.01 relative to butyl acrylate.

Once the peat moss or stripper has absorbed hydrocarbon, such as a VOC, it is believed the VOC will not be released.

Passing Gas Stream Potentially Containing a VOC Through a VOC Stripper

According to a method of the inventions, a gas stream that potentially contains or is expected to contain a VOC is induced to flow though a VOC stripper. There are many sources of gaseous materials that may include one or more VOCs. It is desirable to reduce the emissions of the VOCs into the atmosphere. Examples of such gaseous sources include without limitation: plunger pumps, centrifugal pumps, compressors, valves, storage tanks, tanker trucks, barges, pipe lines, or other gas-vapor sources, before they are vented to the atmosphere.

The step of passing a gas stream through the container for the VOC-absorbing material preferably includes directing the gas stream from a VOC emissions source through a trap containing the stripper. The trap preferably is designed such that the gas stream passes through the trap. A stripper for a VOC is positioned operatively within the trap. The physical form of the stripper on a substrate is such that the gas stream has high interface contact with the stripper, which helps the stripper absorb the VOC from the gas stream. When the gas stream contacts the stripper, the stripper absorbs and traps at least some of the VOC that may be present in the gas stream before venting the gas stream to the atmosphere.

Packing Cartridge with VOC-Absorbing Element

Accordingly, a packing cartridge is provided including at least one ring of the previously-described packing rings 42 of any of the embodiments shown in U.S. application patent Ser. No. 11/530,720, filed in the United States Patent and Trademark Office on Sep. 11, 2006 formed with a VOC-absorbing material. Most preferably, one of the packing rings 42 that is nearest the low-pressure end of the packing bore of the piston would be made of the VOC-absorbing material.

Independent VOC-Absorbing Element for Pump

Figure 3:
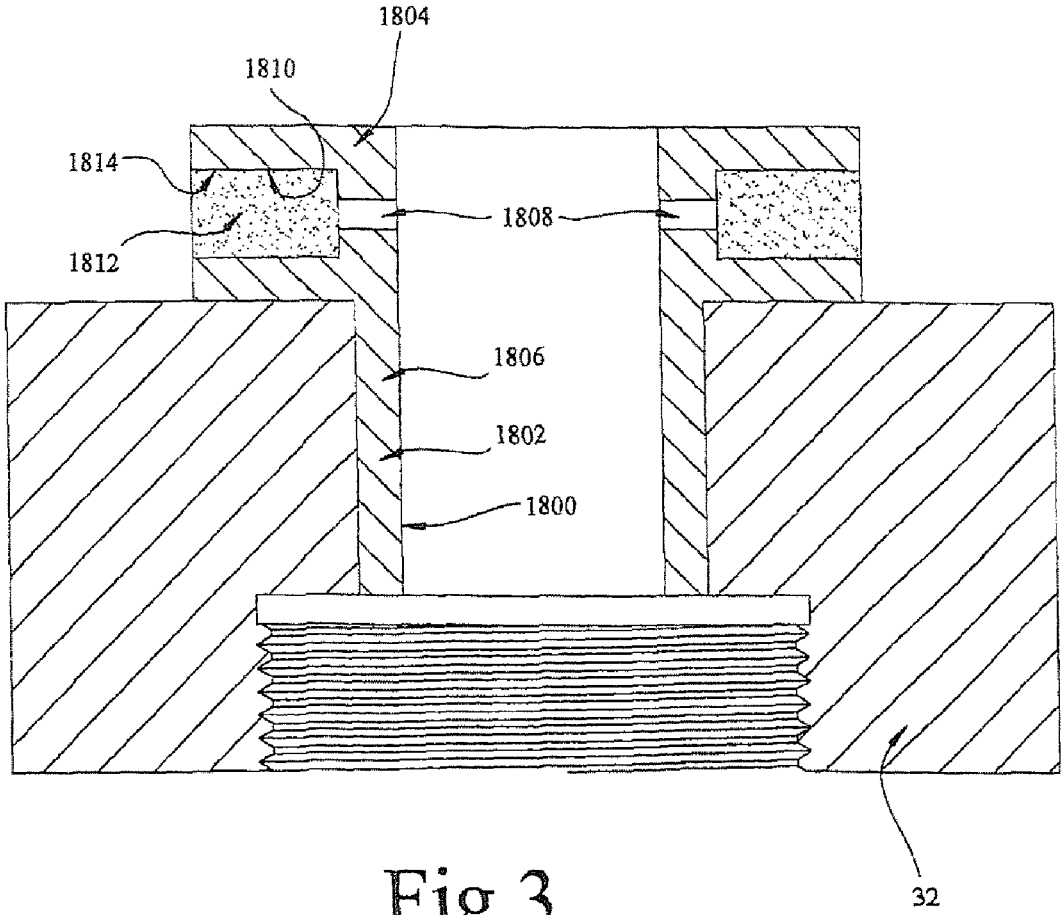
FIG. 3 is a cross-sectional view of a gland nut with an insert for containing a VOC-absorbent material.
Figures 9, 10:
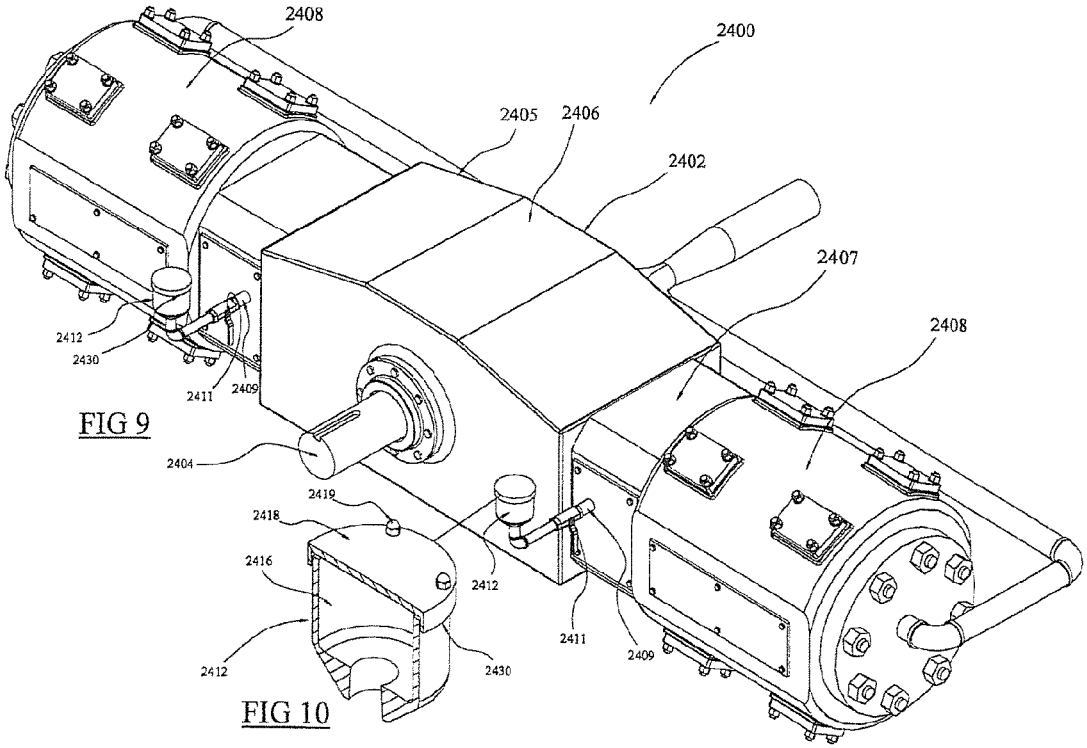
FIG. 9 illustrates an embodiment of the inventions wherein the filter container is connected to an enclosure of a gas compressor, and wherein a VOC-absorbing material can be positioned in a gas outlet line of the enclosure of the gas compressor.
FIG. 10 illustrates a perspective cut-away view of an embodiment of a filter container according to the embodiment shown in FIGS. 6 and 9.

Referring now to FIG. 3, a gland nut 32, similar to the one illustrated in FIG. 10, is shown with an insert 1800 positioned therein. The insert can be retained in the gland nut by any appropriate retainer or nut. The insert 1800 has a sleeve portion 1802 and a collar portion 1804.

The sleeve portion 1802 is adapted to fit with very small clearance between a plunger (not shown) and the gland nut 32. Preferably, at least the sleeve portion 1802 of the insert 1800 is formed of fluorocarbon material, such as Teflon®, which presents a relatively-durable and slick surface 1806 to a piston reciprocating therein.

The collar portion 1804 preferably has at least one aperture 1808 and preferably a plurality of radial apertures 1808 formed therein communicating with a large groove 1810 on the outside of the collar 1802. Positioned in the collar portion 1804 is a ring 1812 of a VOC-absorbing material. The ring 1812 of VOC-absorbing material can be contained in a mesh cloth 1814, having any convenient cross-sectional shape, such as the rectangular cross section illustrated in FIG. 3.

VOC-Absorbing Material for Enclosure of Piston or Plunger

According to another aspect of the inventions, the exposed portion of the reciprocating piston or plunger 38 of a positive displacement pump can be enclosed completely with a cover or container. The enclosing container is adapted to contain a filter media of VOC-absorbing material.

Reciprocating-Pump Apparatuses with an Enclosure and VOC-Absorbing Material

Figure 4:
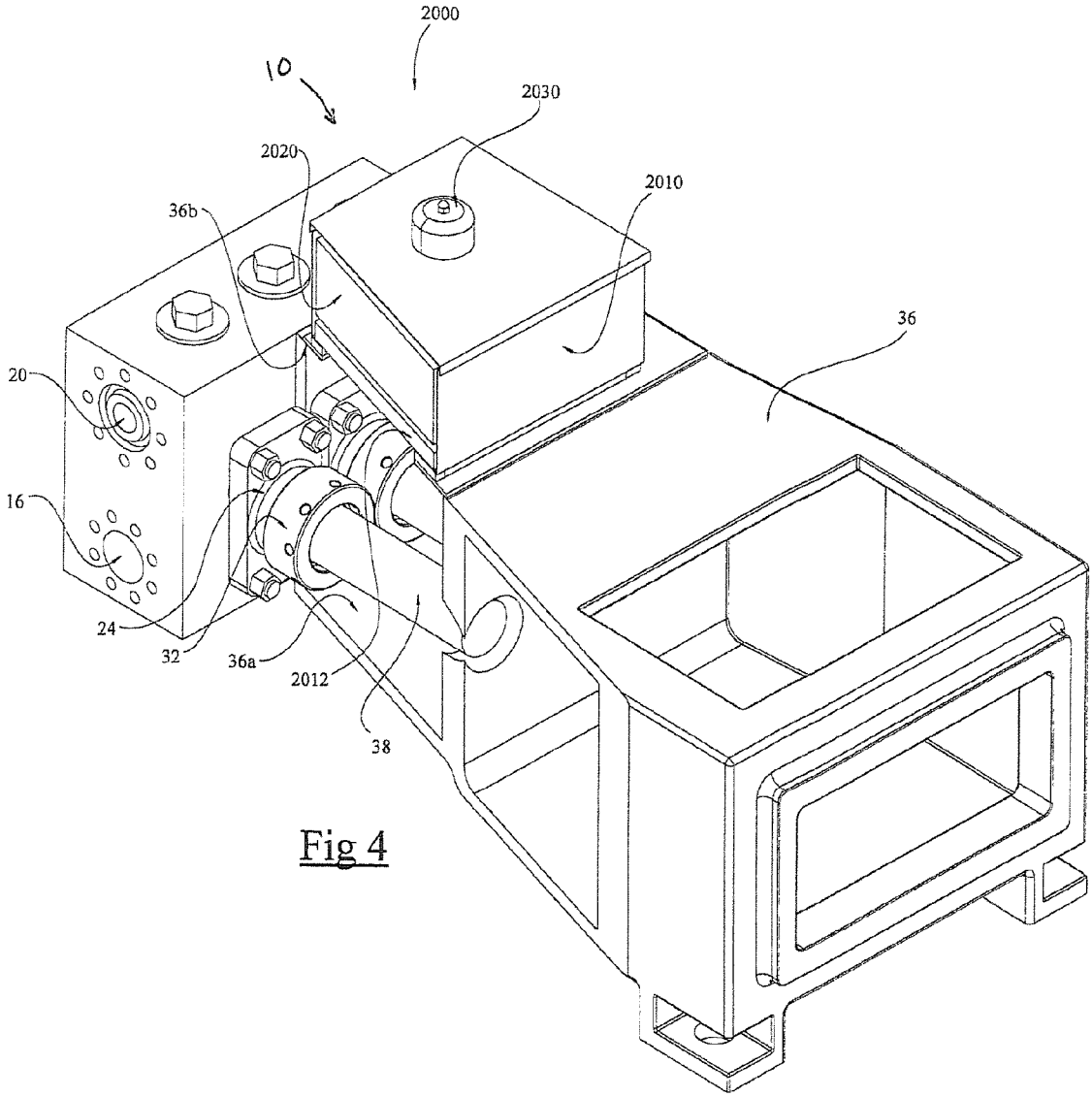
FIG. 4 is a perspective view of an embodiment of the inventions with a cut away of the power frame wherein the fluid end of a plunger pump has a "box" container positioned over the cradle of the power frame for enclosing the exposed end of a plunger and having a VOC-absorbing material positioned therein before an aperture to the atmosphere.

Referring now to FIG. 4, an apparatus 2000 for pumping a fluid according to one embodiment of the invention is provided, wherein the fluid comprises a volatile organic compound. As will be fully appreciated by those skilled in the art, the apparatus 2000 includes a reciprocating piston or plunger pump having a fluid end 10 having a body defining a pumping chamber therein (not shown in FIG. 4). The fluid end 10 also has a suction port 16 through the body to the pumping chamber and a discharge port 18 through the body from the pumping chamber, the function of which is also well known to those of skill in the art. For example, a check valve is positioned operatively in each suction port and discharge port. The fluid end 10 also has a cylindrical port 24 with a packing and a gland nut 32 for a piston or plunger 38 positioned therein to reciprocate in the cylindrical port 24 and pump fluid through the pumping chamber. It should be understood, of course, that the pump fluid end 10 can have a plurality of pistons or plungers 38. A typical positive-displacement fluid pump includes a power frame 36 with a cradle 36*a*. An access opening 36*b* is usually provided in the cradle 36*a* of the power frame 36. The access opening 36*b* permits access for inspection and maintenance, for example, for changing the packing in the cylindrical port 24 for the piston or plunger 38. As used herein, the exposed portion of the reciprocating piston or plunger 38 refers to the end portion that extends and reciprocates out from the fluid end 10 into the cradle 36*a*.

According to a presently-preferred embodiment of this aspect of the inventions, the apparatus 2000 also has an enclosure for the exposed end of the piston or plunger 38, wherein the enclosure comprises the cradle 36*a* of the power frame 36 and a container 2010. The container 2010 is adapted to be positioned on the cradle 36*a* of the power frame 36 of, for example, a piston pump, to cover the opening 36*b* in the power frame 36. The container 2010 can be, for example, box-shaped.

The bottom periphery of the container 2010 is sealed onto the periphery of the access opening 36*b* of the cradle 36*a*, for example, by placing a bead of caulking material (not shown in FIG. 4) on the periphery of the access opening 36*b* and/or on the periphery of the bottom of the container 2010 prior to positioning the container over the opening 36*b*. As the container 2010 is placed over the opening 36*b*, the caulking material forms a substantially air-tight seal between the bottom periphery of the container 2010 and the periphery of the access opening 36*b*. When it is desired to remove the container 2010, it can be grasped simply with hands on the sides thereof and lifted from the cradle 36*a*, as the caulking material will yield to a manual lifting force. If additional force is needed to remove the container 2010 for any reason, the bottom of the container 2010 can be pried off the cradle 36*a* of the power frame with any suitable thin tool placed between the bottom of the periphery of the container 2010 and the top of the periphery of the access opening 36*b* of the cradle 36*a*. The container may be screwed down onto the periphery of the access opening 36*b*, however, such a secure form of attachment normally is not expected to be necessary. If the container 2010 is screwed down at several points around the periphery of the bottom thereof onto the cradle such that it forms a substantially air-tight seal, a caulking material may be optional.

The bottom of the container 2010 has one opening or a plurality of openings therein to communicate with the access opening 36*b* of the cradle 36*a*. For example, the bottom of the container 2010 can have a support 2012 at the bottom thereof formed of a screen material on which a filter media 2020 of a VOC-absorbing material can be supported. The container 2010 on the frame 36 constrains any gases, including any VOC, that escape from the piston seals of the pump to enter the container 2010 and pass through a filter media 2020 before being released to the atmosphere through a breathing aperture 2030. The filter media 2020 is positioned such that all gases must pass through the filter media before being released to the atmosphere through the breathing aperture 2030, which can be located conveniently, for example on the top of the container 2010. The VOCs are trapped in the filter media 2020, which can be in a shape adapted to fit within the box-shaped container 2010.

The top of the container 2010 can be adapted to be opened, whereby the filter media 2020 positioned therein can be changed with fresh filter media without necessarily removing the container 2010 from the cradle 36*a*.

Any other openings in or from the cradle 36*a* also should be closed substantially to the atmosphere to constrain any gases, including any VOC, to leave the cradle 36*a* only through the filter media 2020 in the container 2010 and out through the breathing aperture 2030, whereby a substantial portion of any VOC in the gases escaping from the cylindrical port 24 are trapped in the filter media 2020.

Preferably, the VOC-absorbing material 2020 comprises peat moss and a stripper. If desired, the filter media may further comprise other filtering material, such as HEPA filter material, with the VOC-absorbing material.

Figure 5:
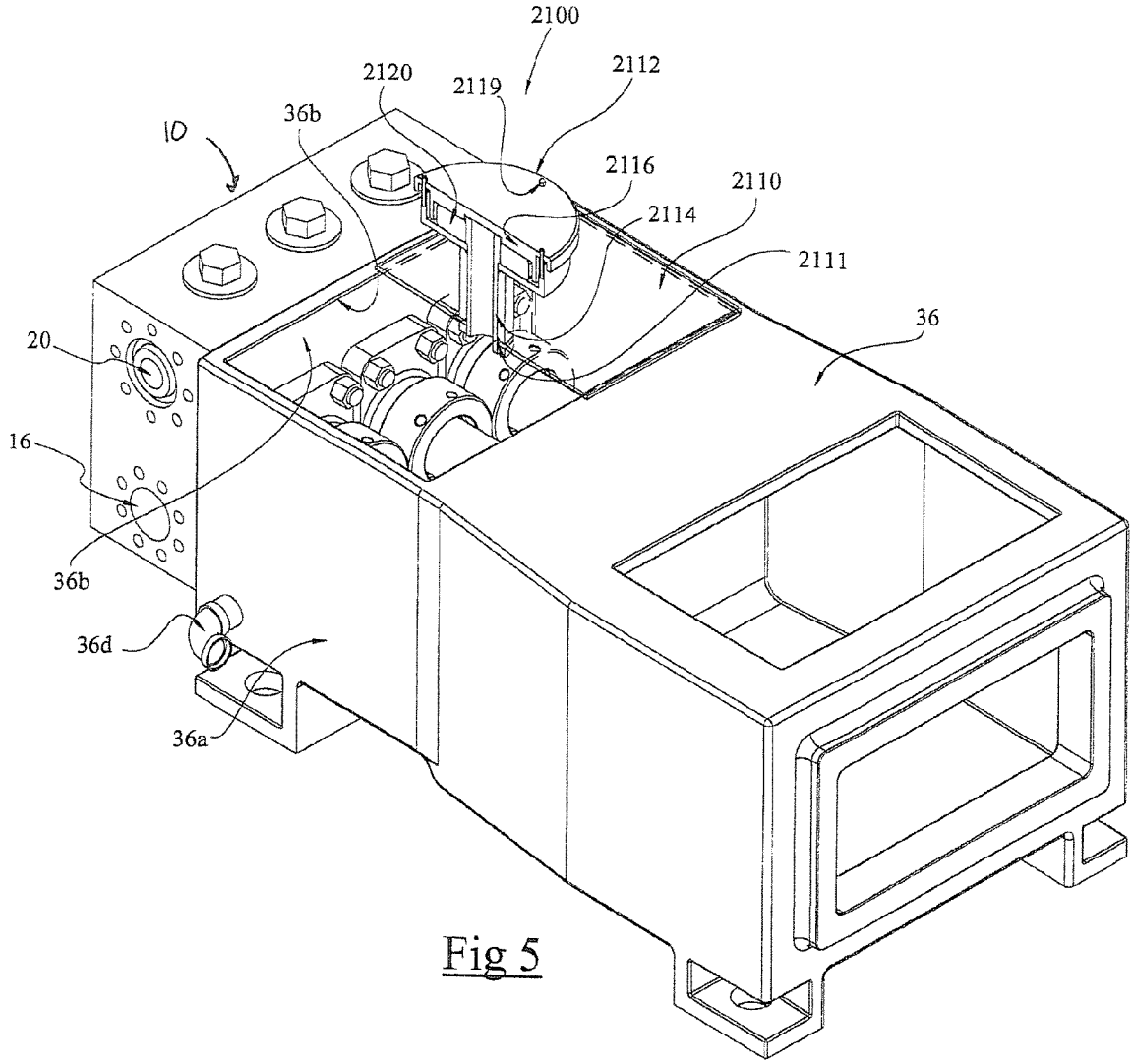
FIG. 5 is a perspective view of an embodiment of the inventions wherein the fluid end of a plunger pump has a sealed transparent cover positioned over the cradle of the power frame for enclosing the exposed end of a plunger and having a filter container positioned to extend through the transparent cover.

Referring now to FIG. 5, an apparatus 2100 for pumping a fluid according to one embodiment of the inventionx is provided, wherein the fluid comprises a volatile organic compound. As will be fully appreciated by those skilled in the art, the apparatus 2100 shown in FIG. 5 includes a reciprocating piston or plunger pump that is substantially the same as the pump shown in FIG. 4 and described above.

In the embodiment shown in FIG. 5, the enclosure for the exposed end of the piston or plunger 38 comprises the cradle 36*a* of the power frame 36 and a cover 2110. The cover 2110 is positioned over the access opening 36*b* of the cradle 36*a* of the power frame 36. Preferably, the cover 2110 is transparent so that it is possible to visually inspect the exposed end of the piston or plunger 38. A suitable transparent material for the cover 2110 is polymethylmethacrylate, commercially available as Plexiglas®. The cover 2110 is sealed onto the periphery of the access opening 36*b* of the cradle 36*a*, for example, by placing a bead of caulking material (not shown in FIG. 5) on the periphery of the access opening 36*b* and/or on the periphery of the bottom of the cover 2110 prior to positioning the cover over the opening 36*b*. As the cover 2110 is placed over the opening 36*b*, the caulking material forms a substantially air-tight seal between the bottom periphery of the cover 2110 and the periphery of the access opening 36*b*. When it is desired to remove the cover 2110, it can be grasped simply with fingers of the hands at the edges thereof and lifted from the cradle 36*a*, as the caulking material will yield to a manual lifting force. If additional force is needed to remove the cover 2110 for any reason, the cover 2110 can be pried off the cradle 36*a* of the power frame with any suitable thin prying tool placed between the bottom of the periphery of the cover 2110 and the top of the periphery of the access opening 36*b* of the cradle 36*a*. The cover 2110 may be screwed down onto the periphery of the access opening 36*b*, however, such a secure form of attachment normally is not expected to be necessary. If the cover 2110 is screwed down at several points around the periphery onto the cradle such that it forms a substantially air-tight seal, a caulking material may be optional.

According to the embodiment shown in FIG. 5, a filter container, generally referred to by the reference 2112, is attached to an opening 2111 in the cover 2110. The container 2112 has a vertically-oriented tubular section 2114 connected at a lower end thereof to the cover 2110. The lower end can be connected to the cover 2110 by any convenient means. The upper end of the container 2112 has a generally donut-shaped chamber 2116 for containing a filter media 2120. A breathing aperture 2130 is provided, which can be, for example, a gap under the rim of a lid 2118. A plurality of screws 2119 can be employed to secure the lid 2118 to the rest of the filter container 2112.

As can be seen in FIG. 5 and will be appreciated by those of skill in the art, gases from the cradle 36*a* can travel up through the tubular section 2114, through the chamber 2116 with a filter media 2120 positioned therein, and out through the breathing aperture 2130 to the atmosphere. A substantial amount of any VOC in the gases should be trapped in the filter media 2120. The purpose of having the chamber 2116 raised above the cover 2110 is to allow better visual inspection into the cradle 36*a* through a transparent cover 2110.

Any other openings in or from the cradle 36*a* also should be closed substantially to the atmosphere. For example, as shown in FIG. 5, it is common for a cradle 36*a* of a power frame 36 to have a liquid drain 36*d* toward the bottom thereof. The drain 36*d* can be closed, or more preferably, a liquid trap (not shown in FIG. 5) as well known in the art can be positioned on the drain 36*d* to allow liquid to drain out, while containing gases. It is important to constrain any gases, including any VOC, to leave the cradle 36*a* only through the filter media 2120 in the container 2112 and out through the breathing aperture 2130, whereby a substantial portion of any VOC in the gases escaping from the cylindrical port 24 are trapped in the filter media 2120.

Preferably, the VOC-absorbing material 2120 comprises peat moss and a stripper. The filter media may further comprise, if desired, other filtering material, such as HEPA filter material, with the VOC-absorbing material.

Figure 6:
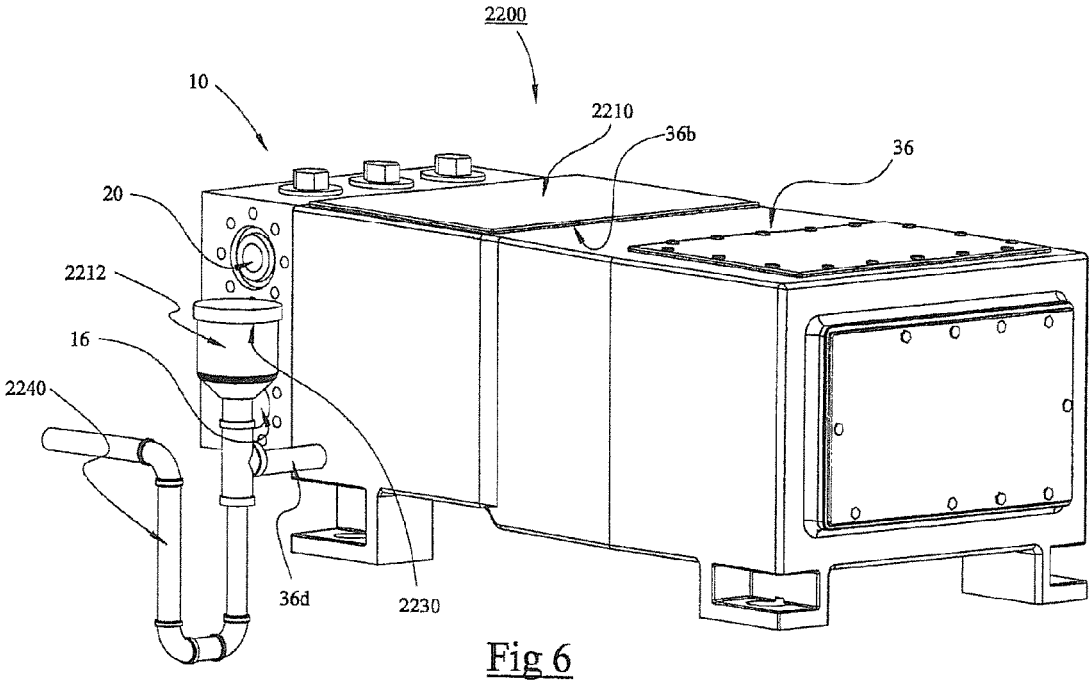
FIG. 6 is a perspective view of an embodiment of the inventions wherein the fluid end of a plunger pump has a cover positioned over the cradle of the power frame for enclosing the exposed end of a plunger, and wherein a VOC-absorbing material can be positioned in a filter container to be attached as a vent to a drain line from the enclosure.

Referring now to FIG. 6, an apparatus 2200 for pumping a fluid according to one embodiment of the inventions is provided, wherein the fluid comprises a volatile organic compound. As will be fully appreciated by those skilled in the art, the apparatus 2200 shown in FIG. 6 includes a reciprocating piston or plunger pump that is substantially the same as the pump shown in FIG. 4 and described above.

In the embodiment shown in FIG. 6, the enclosure for the exposed end of the piston or plunger 38 of the reciprocating pump comprises the cradle 36*a* of the power frame 36 and a cover 2210. The cover 2210 substantially is similar to the cover 2110 as described in reference to FIG. 5 above, except that in this embodiment of the cover 2210 there is no need for any opening, such as opening 2111 described with reference to the cover 2110 in FIG. 5. The cover 2210 can be sealed onto the periphery of the access opening 36*b* of the cradle 36*a* as previously described with respect to the cover 2110 in the embodiment of FIG. 5.

Continuing to refer to the embodiment shown in FIG. 6, a VOC-absorbing material can be positioned in a filter container 2212 adapted to be connected as a vent attached to a drain 36*d* from the enclosure of the cradle 36*a* and the cover 2210. The filter container 2212 has a breathing aperture 2230. The filter container 2212 and the breathing aperture 2230 generally are similar in structure to the filter container 2112 and breathing aperture 2130 as discussed with reference to FIG. 5. Thus, in the embodiment shown in FIG. 6, the VOC-absorbing material is positioned in a drain line 2240 from the cradle 36*a*.

As can be seen in the FIG. 6 and will be appreciated by those of skill in the art, gases from the cradle 36*a* can travel through the drain 36*d* and upwardly through the filter container 2212, through a chamber therein with a filter media positioned therein, and out through the breathing aperture 2230 at the lid thereof to the atmosphere. A substantial amount of any VOC in the gases should be trapped in the filter media in the filter container 2212.

The drain 36*d* can be closed, or more preferably, as shown in FIG. 6, a liquid trap in the form of a U-shaped drain line 2240 can be positioned on the drain 36*d* to allow liquid to drain out while containing gases. Liquid collects in the U-shaped drain line to provide a liquid trap, under normal operating conditions preventing the passage of gasses past the U-shaped drain line 2240 and directing the gases upward toward the filter container 2212. It is important to constrain any gases, including any VOC therein, to leave the cradle 36*a* only through the filter media in the container 2212 and out through the breathing aperture 2230 thereof, whereby a substantial portion of any VOC in the gases escaping from the cylindrical port (not shown in FIG. 6) are trapped in the filter media.

Preferably, the VOC-absorbing material placed in the filter container 2212 comprises peat moss and a stripper. The filter media may further comprise, if desired, other filtering material, such as HEPA filter material, with the VOC-absorbing material.

Figure 7:
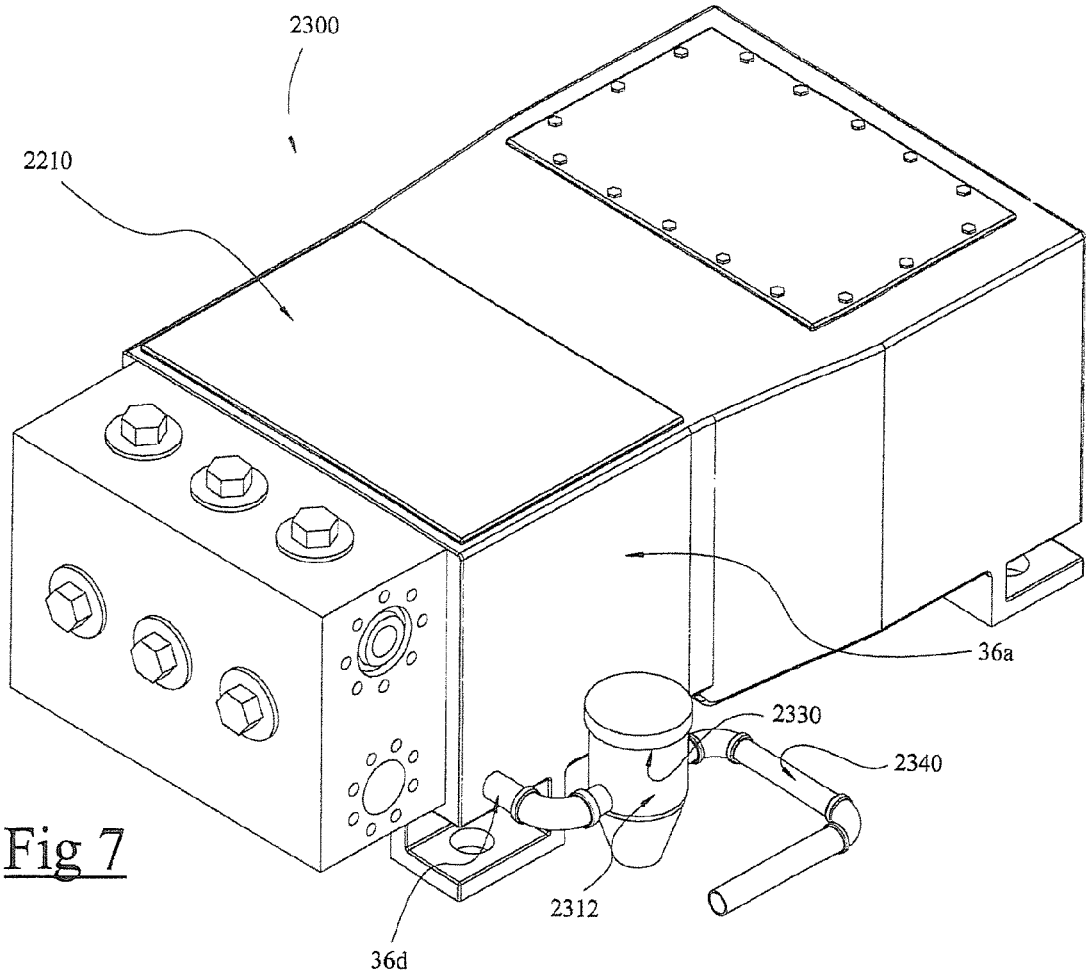
FIG. 7 is a perspective view of an embodiment of the inventions wherein the fluid end of a plunger pump has a cover positioned over the cradle of the power frame for enclosing the exposed end of a plunger, and wherein a VOC-absorbing material can be positioned in a filter container combined with a liquid trap to be connected in-line with a drain line from the enclosure.

Referring now to FIG. 7, an apparatus 2300 for pumping a fluid according to one embodiment of the inventions is provided, wherein the fluid comprises a volatile organic compound. As will be appreciated fully by those skilled in the art, the apparatus 2300 shown in FIG. 7 includes a reciprocating piston or plunger pump that is substantially the same as the pump shown in FIG. 4 and described above.

In the embodiment shown in FIG. 7, the enclosure for the exposed end of the piston or plunger of the reciprocating pump comprises the cradle 36*a* of the power frame 36 and a cover 2210. The cover 2210 for the cradle 36*a* is substantially the same as the cover 2210 as described with reference to FIG. 6.

Continuing to refer to the embodiment shown in FIG. 7, a VOC-absorbing material can be positioned in a filter container 2312 adapted to be connected as a vent attached to a drain 36*d* from the enclosure of the cradle 36*a* and the cover 2210. The filter container 2312 has a breathing aperture 2330. The filter container 2312 also includes a liquid trap, as will hereinafter be described in detail with respect to FIG. 8.

Figure 8:
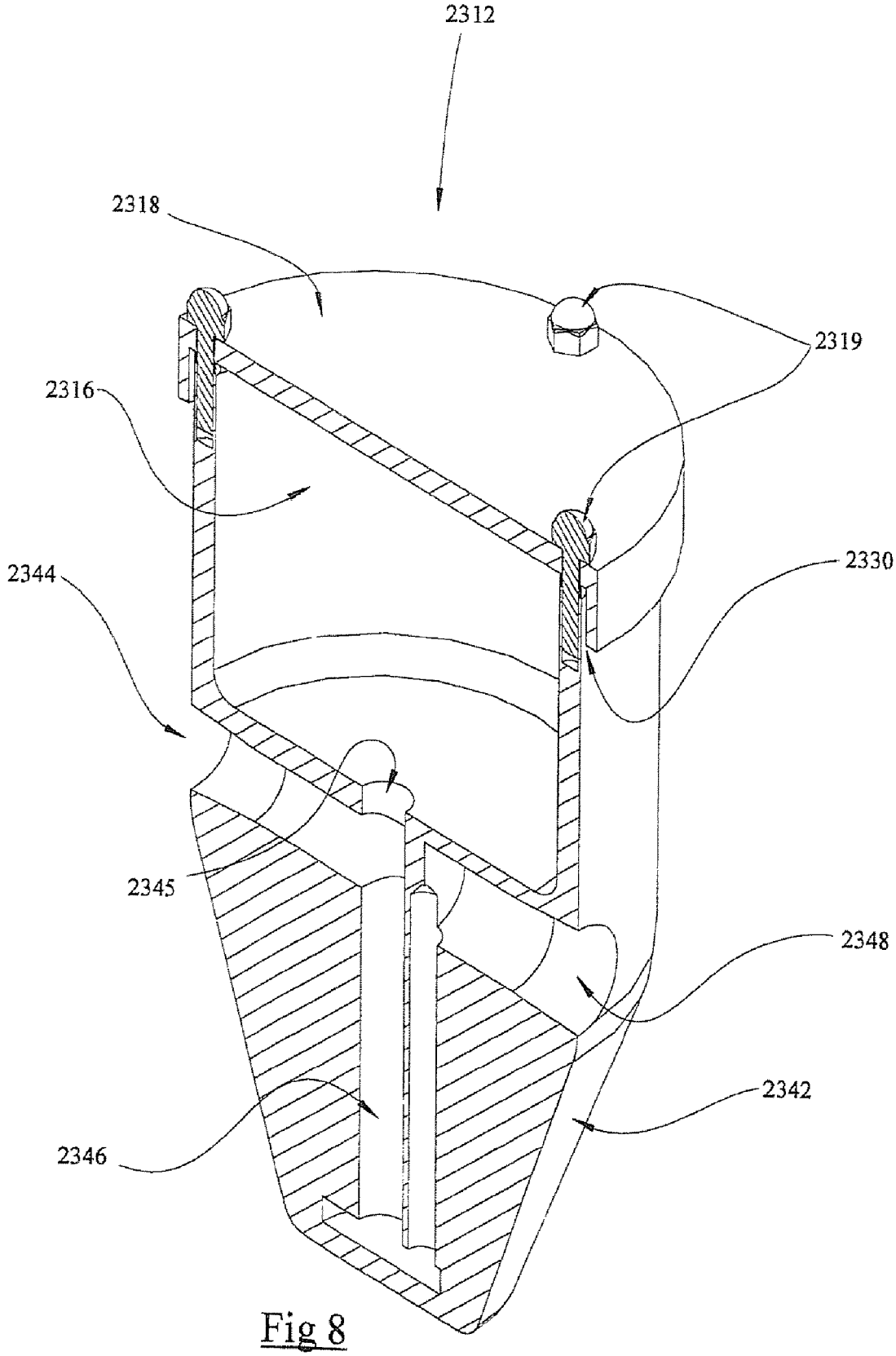
FIG. 8 is a perspective cut-away view of an embodiment of a filter container having a liquid trap, wherein the filter container with the liquid trap is adapted to be connected in-line with a drain line from an enclosure for the exposed end of the piston or plunger of the reciprocating pump.

Referring now to FIG. 8, a perspective cut-away view is shown of an embodiment of a filter container having a liquid trap, wherein the filter container with the liquid trap is adapted to be connected in-line with a drain line from an enclosure for the exposed end of the piston or plunger of the reciprocating pump. According to the embodiment shown in FIG. 8, a filter container, generally referred to by the reference 2312, has a liquid trap, generally referred to by the reference 2342, associated therewith.

The filter container 2312 has a chamber 2316 for containing a filter media therein (not shown in FIG. 8). A breathing aperture 2330 is provided, which can be, for example, a gap under the rim of a lid 2118 to the chamber 2316. A plurality of screws 2319 can be employed to secure the lid 2318 to the rest of the filter container 2312.

The liquid trap 2342 has a fluid inlet 2344, a U-shaped tubular section 2346, and a liquid outlet 2348. Any convenient barrier fluid, such as oil, which will not evaporate, can be placed in the U-shaped tubular section 2346 to block gasses from escaping to the liquid outlet 2348. A port 2345 from the fluid inlet 2344 is positioned operatively to allow the passage of gases from the fluid inlet 2344 to the chamber 2316 of the filter container 2312. The fluid inlet 2344 and the liquid outlet 2348 can be connected in-line with a drain line 2340. Any liquid oil draining from the drain 36*d* of the cradle 36*a* (shown in FIG. 7) through a drain line 2340 can pass through the U-shaped tubular section 2346 and out the liquid outlet 2348. As will be appreciated by those of skill in such art, the liquid trap operates under the principles of fluid flow under the influence of gravity. The liquid outlet 2348 should be positioned such that under normal draining conditions any liquid in the drain line 2340 is not caused to back up through the port 2345 from the fluid inlet 2344 into the chamber 2316 of the filter container 2312.

As can be seen in the FIGS. 7 and 8 and will be appreciated by those of skill in the art, gases from the cradle 36*a* can travel through the drain 36*d* and drain line 2340 and through the liquid trap 2342. Any liquid from the cradle 36*a* should flow through the in-line liquid trap 2342 and continue out the liquid outlet 2348 down the drain line 2340. Any gasses from the enclosure formed by the cradle 36*a* and cover 2210 should be directed upwardly from the port 2345 through the filter container 2312, through the chamber 2316 therein with a filter media positioned therein, and out through the breathing aperture 2330 at the lid 2318 thereof to the atmosphere. A substantial amount of any VOC in the gases should be trapped in the filter media in the chamber 2316 of the filter container 2312.

Gas-Compressor Apparatuses with an Enclosure and VOC-Absorbing Material

According to another aspect of the inventions, the exposed portion of the reciprocating piston or plunger of a gas compressor can be enclosed completely, and the enclosing container is adapted to contain a filter media of VOC-absorbing material.

Referring now to FIG. 9, an apparatus 2400 for pumping a gaseous fluid according to one embodiment of the inventions is provided, wherein the fluid comprises a volatile organic compound. As will be fully appreciated by those skilled in the art, the apparatus 2400 shown in FIG. 9 includes a reciprocating piston or plunger pump that generally is similar to the pump shown in FIG. 4 and described above. More particularly, however, according to this embodiment, the filter container 2412 is connected operatively to a typical gas compressor 2402, wherein the gas compressor 2402 includes a crankshaft 2404 and an overall enclosure 2405 including a power frame 2406, a piston rod cradle 2407 for piston rods (not shown), and pump bodies 2408 for the pumping chamber. The typical gas compressor 2402 includes other elements well known in the art.

Continuing to refer to the embodiment shown in FIG. 9, a VOC-absorbing material can be positioned in the filter container 2412 adapted to be connected as a vent attached to a gas outlet 2409 from the enclosure 2405 of the gas compressor 2402. The gas outlet 2409 optionally may be equipped with a ball valve 2411 to selectively open or close the gas outlet. The filter container 2412 has a breathing aperture 2430. Thus, in the embodiment shown in FIG. 9, the VOC-absorbing material is positioned in a gas outlet 2411 from the enclosure 2405.

As can be seen in the FIG. 9 and will be appreciated by those of skill in the art, gases from the enclosure 2405 can travel through the gas outlet 2411 and upwardly through the filter container 2412, through a chamber therein with a filter media positioned therein, and out through the breathing aperture 2230 at the lid thereof to the atmosphere. A substantial amount of any VOC in the gases should be trapped in the filter media in the filter container 2412.

Referring now to FIG. 10, the filter container 2412 is illustrated in more detail. The filter container 2412 has a chamber 2416 for containing a filter media therein (not shown in FIG. 10). A breathing aperture 2430 is provided, which can be, for example, a gap under the rim of a lid 2418 to the chamber 2416. A plurality of screws 2419 can be employed to secure the lid 2418 to the rest of the filter container 2412. The example of the filter container 2412 is of the same design as the filter container 2212 shown in FIG. 6. For an embodiment including a gas compressor, which is particularly intended to be used for pumping a fluid that would be gaseous at standard temperature and pressure, a liquid trap may not be needed.

Preferably, the VOC-absorbing material placed in the filter container 2412 comprises peat moss and a stripper. The filter media may further comprise, if desired, other filtering material, such as HEPA filter material, with the VOC-absorbing material.

Impeller-Pump Apparatuses with an Enclosure and VOC-Absorbing Material

According to another aspect of the inventions, the enclosure of an impeller pump for a fluid can be enclosed completely, and the enclosing container is adapted to contain a filter media of VOC-absorbing material.

Figure 11:
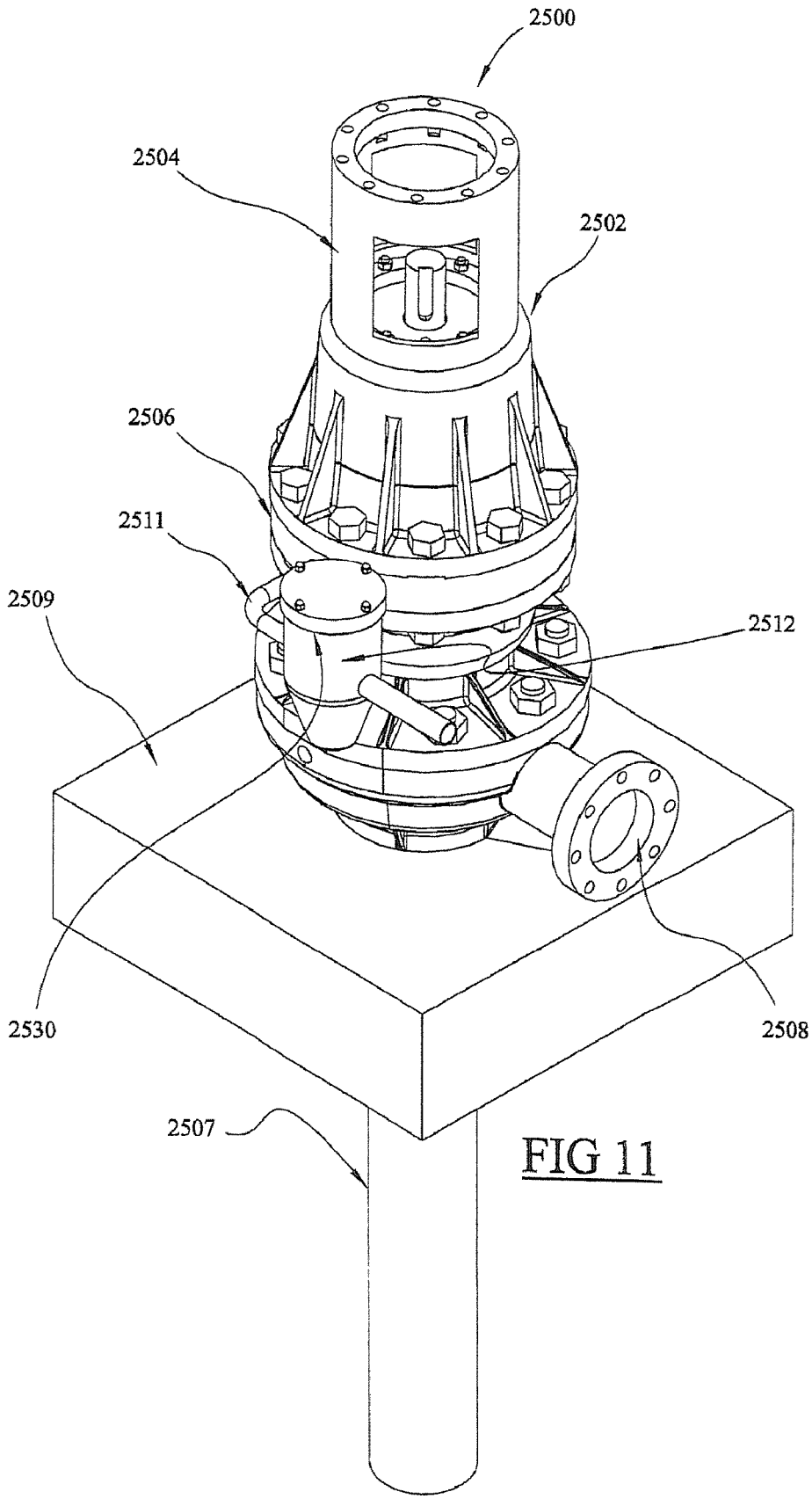
FIG. 11 illustrates a perspective view of an embodiment wherein a filter container for the VOC-absorbing material is positioned in a gas vent line from a vertical gas pump.

Referring now to FIG. 11, an apparatus 2500 for pumping a gaseous fluid according to one embodiment of the inventions is provided, wherein the fluid comprises a volatile organic compound. As will be fully appreciated by those skilled in the art, the apparatus 2500 shown in FIG. 11 includes a typical impeller gas pump 2502, wherein the impeller gas pump 2502 includes a motor stand 2504, a seal housing 2506 having a impeller therein (not shown), a suction inlet line 2407, and a fluid outlet line 2508. The impeller gas pump 2502 can be mounted, for example, on a cement pad 2509. The typical gas compressor 2502 includes other elements well known in the art.

Continuing to refer to the embodiment shown in FIG. 11, a VOC-absorbing material can be positioned in the filter container 2512 adapted to be connected as a vent attached to a gas outlet 2511 from the seal housing 2506 of the gas compressor 2502. The filter container 2512 has a breathing aperture 2530. The filter container 2512 preferably has the same design as shown in FIG. 8 with respect to the filter container with a liquid trap. Thus, in the embodiment shown in FIG. 11, the VOC-absorbing material is positioned in a gas outlet 2511 from the enclosure 2506.

As can be seen in the FIG. 11 and will be appreciated by those of skill in the art, gases from the enclosure 2506 can travel through the gas outlet 2511 and upwardly through the filter container 2512, through a chamber therein with a filter media positioned therein, and out through the breathing aperture 2530 at the lid thereof to the atmosphere. A substantial amount of any VOC in the gases should be trapped in the filter media in the filter container 2512.

Methods of Pumping a Fluid Containing a VOC

According to yet another aspect of the inventions, a method of pumping a fluid from a low-pressure fluid source to a high-pressure fluid outlet is provided, wherein the fluid comprises a volatile organic compound. According to a preferred embodiments of this aspect of the inventions, and with reference, for example, to the apparatuses shown in any of FIGS. 4-7 and 9, the suction port of the pump is connected operatively to the low-pressure fluid source (not shown), and the discharge port is connected to a high-pressure fluid outlet line. According to this presently-preferred embodiment, the method comprises the steps of: (i) reciprocating the piston or plunger 38 in the cylindrical port 24 to pump fluid from the low-pressure fluid source to the high-pressure fluid outlet line; and (ii) periodically changing the VOC-absorbing material.

The method of pumping preferably further comprises the steps of: (iii) opening the enclosure; (iv) changing a packing for the piston or plunger 38 in the cylindrical port; and (v) closing the enclosure. The packing is preferably in the form of a packing cartridge.

More preferably, in some embodiments of the inventions, the step of closing the enclosure further comprises: scaling the enclosure by sealing a cover onto the cradle of the power frame with a caulking material. The caulking material can be placed as a bead around the periphery of an access opening in the cradle and/or the peripheral edges of the cover to be positioned over the access opening of the cradle.

In the method of pumping, the VOC-absorbing material preferably comprises peat moss and a stripper.

Methods for Reducing VOC Emissions from a Pump

According to another aspect of the inventions, a method for reducing emissions of a volatile organic compound from a pump, such as a positive-displacement pump used for pumping a fluid, wherein the fluid comprises the VOC, wherein the pump can be of the type described above with respect to any of FIGS. 4-7 and 9. According to the preferred embodiment, the method comprises the steps of: (i) enclosing at least the exposed portion of the reciprocating piston or plunger 38 to form an enclosure; and (ii) operatively positioning a VOC-absorbing material to reduce VOC emissions from the enclosure to the atmosphere.

According to the methods of the inventions, the step of enclosing preferably further comprises: enclosing the access opening of the cradle of a power frame of the pump, which forms an enclosure. For example, the step of enclosing the exposed power frame of the pump preferably further comprises: covering a cradle of the exposed power frame. More preferably, the step of covering the cradle further comprises: positioning a transparent cover on the cradle, whereby it is possible to view inside the enclosure formed by the cradle and the cover. The transparent cover is preferably a plastic material. Suitable examples of a plastic material include, without limitation, methyl methacrylate, sold under widely recognized brand names such as Plexiglass®.

Preferably, the step of covering the cradle further comprises: attaching and sealing the cover to the cradle with a caulking material. Suitable examples of a caulking material include silicone, polyurethane, polysulfide, sylil-terminated-polyether or polyurethane and acrylic sealant.

According to a first embodiment, the step of operatively positioning the VOC-absorbing material includes positioning the VOC-absorbing material in the in the enclosure between a fluid end of the pump and a breathing aperture to the atmosphere.

According to a second embodiment, the step of operatively positioning the VOC-absorbing material includes positioning the VOC-absorbing material in a drain or vent line between the enclosure and a breathing aperture to the atmosphere, for example, with a liquid trap as shown in FIGS. 7-8.

According to a third embodiment, the step of operatively positioning the VOC-absorbing material includes positioning the VOC-absorbing material with a liquid trap operatively connected to a drain or fluid line from the enclosure. For example, the fluid line can be a drain line from the enclosure, and the liquid trap can be connected to the drain line from the enclosure. Further, for example, the trap can include: (a) a liquid container defining a lower liquid chamber and an upper chamber for the VOC-absorbing material; (b) a removable lid for accessing the upper chamber for the VOC-absorbing material; (c) a fluid inlet line into the lower liquid chamber of the container adapted to be connected to a drain line from the enclosure; (d) a fluid outlet line adapted to be connected to a drain line to fluid waste, wherein the fluid inlet and fluid outlet are positioned in the liquid chamber such that a liquid barrier can be maintained between the fluid inlet and fluid outlet; and (e) a breathing aperture from the upper chamber, whereby any gases in the fluid from the fluid inlet pass through the VOC-absorbing material before being vented to the atmosphere.

According to yet another aspect of the inventions, a method is provided for reducing emissions of a volatile organic compound from an impeller pump for pumping a fluid wherein the fluid comprises the VOC. The method comprises the steps of: (i) operatively positioning a VOC-absorbing material to reduce VOC emissions from the impeller pump; (ii) pumping the fluid through the impeller pump.

According to the methods, the VOC-absorbing material preferably comprises peat moss and a stripper.

The methods preferably further comprise the step of periodically replacing the VOC-absorbing material with fresh VOC-absorbing material, that is, with the same or similar VOC-absorbing material that has been re-generated or is new.

The methods preferably further comprises the step of testing for leaks of VOCs from the enclosure to the atmosphere. More preferably, the step of testing for leaks further comprises: using a testing probe in the atmosphere in the vicinity of all joints of the enclosure and in the atmosphere in the vicinity of any breathing aperture from the enclosure to test for VOCs. Further, the method preferably comprises the step of: after detecting an undesirable concentration of VOCs in the atmosphere in the vicinity of any joints of the enclosure and in the atmosphere in the vicinity of any vent from the enclosure, changing the used VOC-absorbing material with new or re-newed, active VOC-absorbing material.

Exposing at Least Stripper of VOC-Absorbing Material to Bacteria

After the VOC stripper has absorbed one or more VOCs, disposal or remediation of the VOC stripper is a problem. This is especially so in the case of some aromatic VOCs, which are considered to be toxic and carcinogenic. Materials containing aromatic VOCs such as benzene, toluene, and xylene can be unsafe or illegal to dispose of in a landfill or other waste disposal places.

According to the inventions, a bacteria is selected for being capable of converting the VOC to another compound. Preferably, the bacteria is selected for being capable of digesting at least one aromatic VOC. More preferably, the bacteria is selected for being capable of digesting at least one aromatic VOC selected from the group consisting of benzene, toluene, or a xylene. This type of bacteria is also known as being oleophilic.

For example, such bacteria can be selected from the group consisting of: pseudomonas, bacillus, and any combination thereof. More specifically, the bacteria can be selected from the group consisting of: methylocella, cycloclasticus, lutibacterium, alcanivorax, and any combination thereof. Another example of a bacteria capable of digesting an aromatic compound such as benzene, for example, is disclosed in U.S. Pat. No. 5,753,122 filed Mar. 4, 1996 and issued May 19, 1998, which is hereby incorporated by reference in its entirety. Most preferably, the bacteria is also non-pathogenic.

The methods of the inventions include the step of biologically consuming at least the aromatic VOCs absorbed in the VOC stripper. Preferably, the step of exposing the stripper of the VOC-absorbing material to bacteria includes exposing the stripper to the bacteria after an undesirable concentration of the VOC is detected in the atmosphere in the vicinity of the breather aperture. It should be understood that the step of exposing the stripper of the VOC-absorbing material to the bacteria can include exposing all of the VOC-absorbing material, including the substrate, to the bacteria.

According to the inventions, the step comprises using bacteria to digest at least the aromatic VOCs before the disposal of the VOC stripper containing such VOC, especially if the VOC is aromatic. Exposing the stripper of the VOC-material to such oleophilic bacteria and allowing the bacteria to digest or convert the VOC to another compound or compounds is expected to allow it to be disposed of legally in a landfill.

According to another aspect of the inventions, the method includes the step of re-generating the VOC stripper for further use as a VOC stripper in a method according to the inventions.

The stripper containing the VOC can be placed in a bioreactor with the bacteria and, under sufficient conditions to temperature, nutrients, bacterial respiration, and time, to biologically degrade at least the aromatic VOCs to acceptably low levels for disposal. If the bacterial degradation does not also destroy or consume the VOC stripper, it may be re-used in a VOC-absorbing material according to the inventions.

CONCLUSION

The inventions are described with respect to presently-preferred embodiments, but are not intended to be limited to the described embodiments. As will be readily apparent to those of ordinary skill in the art, numerous modifications and combinations of the various aspects of the inventions and the various features of the preferred embodiments can be made without departing from the scope and spirit of the inventions. It should also be understood, for example, that the function of a single structure described herein sometimes can be performed by more than one part, or the functions of two different structures can be performed by a single or integrally formed part. Especially from manufacturing and cost perspectives, it is preferred to design the storage device to minimize the number of parts. These costs include not only the costs associated with making the parts, but also the costs of assembly. Preferably, the fewest possible number of parts and steps required to manufacture and assemble the apparatus, the better. The inventions are to be defined by the appended claims.

What is claimed is:

1. A method for reducing emissions to the atmosphere of a volatile organic compound ("VOC") from a source of the VOC, wherein the source of the VOC is selected from equipment for pumping, storing, handling, or transporting a VOC-containing fluid, wherein the VOC outgases from the VOC-containing fluid, and wherein the method comprises the steps of: (A) operatively positioning a VOC-absorbing material between the source of the VOC and the atmosphere, wherein the VOC-containing fluid remains in the equipment, wherein the VOC from the source of the VOC must pass through the VOC-absorbing material before being vented to the atmosphere, and wherein the VOC-absorbing material comprises: (i) a permeable substrate; and (ii) a stripper for the VOC; (B) exposing the stripper of the VOC-absorbing material to bacteria, wherein the bacteria is selected for being capable of converting the VOC to another compound, and wherein the bacterial degradation does not destroy or consume the VOC stripper; and (C) re-using the stripper in a VOC-absorbing material.

2. The method according to claim 1, wherein the VOC is selected from the group consisting of: benzene, toluene, ethyl benzene, xylene, and any combination thereof in any proportion.

3. The method according to claim 1, wherein the equipment is a positive-displacement pump, a centrifugal pump, a compressor, a valve, a storage tank, a tanker truck, a tanker barge, or a pipe line.

4. The method according to claim 1, wherein the substrate comprises sponge material.

5. The method according to claim 1, wherein the substrate comprises peat moss.

6. The method according to claim 5, wherein the peat moss comprises sphagnum peat moss.

7. The method according to claim 1, wherein the substrate comprises oil-absorbent particulate.

8. The method according to claim 7, wherein the oil-absorbent particulate comprises kitty litter.

9. The method according to claim 1, wherein the substrate is selected from the group consisting of: sand, coffee grounds, kitty litter, sponge, and any combination thereof in any proportion.

10. The method according to claim 1, wherein the stripper comprises a glycol.

11. The method according to claim 1, wherein the stripper comprises monoethylene glycol, diethylene glycol, triethylene glycol, or tetraethylene glycol.

12. The method according to Claim 1, wherein the step of operatively positioning comprises positioning the VOC-absorbing material between an enclosure of the equipment and a breathing aperture to the atmosphere.

13. The method according to claim 12, wherein the step of operatively positioning comprises positioning the VOC-absorbing material in a vent line between the enclosure and the breathing aperture to the atmosphere.

14. The method according to claim 12, wherein the step of operatively positioning comprises positioning the VOC-absorbing material in a trap operatively connected to a fluid line from the enclosure.

15. The method according to claim 14, wherein the fluid line is a drain line from the enclosure, and the trap is connected to the drain line from the enclosure.

16. The method according to claim 15, wherein the trap comprises:

(A) a liquid container defining a lower liquid chamber and an upper chamber for the VOC-absorbing material;

(B) a removable lid for accessing the upper chamber for the VOC-absorbing material;

(C) a fluid inlet line into the lower liquid chamber of the container adapted to be connected to a drain line from the enclosure;

(D) a fluid outlet line adapted to be connected to a drain line to fluid waste, wherein the fluid inlet and fluid outlet are positioned in the liquid chamber such that a liquid barrier can be maintained between the fluid inlet and fluid outlet; and (E) a breathing aperture from the upper chamber, whereby any gases in the fluid from the fluid inlet pass through the VOC-absorbing material before being vented to the atmosphere.

17. The method according to claim 12, further comprising the step of periodically replacing the VOC-absorbing material.

18. The method according to claim 12, further comprising the step of testing for leaking of the VOC from the enclosure to the atmosphere.

19. The method according to claim 18, further comprising the step of:

after detecting an undesirable concentration of the VOC in the atmosphere in the vicinity of the breathing aperture, changing the VOC-absorbing material with fresh or regenerated VOC-absorbing material.

20. The method according to claim 19, wherein the step of exposing the stripper of the VOC-absorbing material to bacteria comprises: after an undesirable concentration of the VOC is detected in the atmosphere in the vicinity of the breathing aperture, exposing the stripper to the bacteria.

21. The method according to claim 1, wherein the bacteria is selected from the group consisting of: pseudomonas, bacillus, and any combination thereof

22. A method for pumping a fluid from a low-pressure fluid source to a high-pressure fluid outlet, wherein the fluid comprises a volatile organic compound ("VOC"), wherein the method comprises the steps of: (A) operatively positioning a VOC-absorbing material between an enclosure for a pump and the atmosphere, wherein the VOC from the enclosure must pass through the VOC-absorbing material before being vented to the atmosphere, and wherein the VOC-absorbing material comprises: (i) a permeable substrate; and (ii) a stripper for the VOC; (B) reciprocating the piston or plunger in the cylindrical port to pump fluid from the low-pressure fluid source to the high-pressure fluid outlet; (C) exposing the stripper of the VOC-absorbing material to bacteria, wherein the bacteria is selected for being capable of converting the VOC to another compound, and wherein the bacterial degradation does not destroy or consume the VOC stripper; and (D) re-using the stripper in a VOC-absorbing material.

23. A method for storing or transporting a fluid, wherein the fluid comprises a volatile organic compound ("VOC"), wherein the method comprises the steps of: (A) storing or transporting the fluid in a closed container, wherein fluid remains in the closed container, and wherein the VOC outgases from the fluid; (B) operatively positioning a VOC-absorbing material between the container and the atmosphere, wherein the VOC from the container must pass through the VOC-absorbing material before being vented to the atmosphere, and wherein the VOC-absorbing material comprises: (i) a permeable substrate; and (ii) a stripper for the VOC; (C) exposing the stripper of the VOC-absorbing material to bacteria, wherein the bacteria is selected for being capable of converting the VOC to another compound, and wherein the bacterial degradation does not destroy or consume the VOC stripper; and (D) re-using the stripper in a VOC-absorbing material.

* * * * *